US008991487B2

(12) United States Patent
Levie et al.

(10) Patent No.: US 8,991,487 B2
(45) Date of Patent: Mar. 31, 2015

(54) PULL THROUGH CENTRALIZER

(75) Inventors: William Iain Elder Levie, The Woodlands, TX (US); Gregory Paul Roger, Houma, LA (US); Miles Norman Sweep, The Woodlands, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 269 days.

(21) Appl. No.: 13/488,122

(22) Filed: Jun. 4, 2012

(65) Prior Publication Data

US 2013/0319690 A1 Dec. 5, 2013

(51) Int. Cl.
*E21B 17/10* (2006.01)

(52) U.S. Cl.
CPC ..... *E21B 17/1028* (2013.01)
USPC ..... 166/241.1; 166/241.6

(58) Field of Classification Search
USPC ..... 166/241.1–241.7
See application file for complete search history.

(56) References Cited

U.S. PATENT DOCUMENTS

| | | | | |
|---|---|---|---|---|
| 2,228,649 | A | 1/1941 | Welles | |
| 2,845,128 | A | 7/1958 | Clark, Jr. et al. | |
| 3,566,965 | A | 3/1971 | Solum | |
| 3,643,739 | A | 2/1972 | Hall, Sr. | |
| 4,088,186 | A | 5/1978 | Callihan et al. | |
| 4,159,742 | A | 7/1979 | Alexander, Jr. | |
| 4,530,399 | A | 7/1985 | Riddle | |
| 5,261,488 | A | 11/1993 | Gullet et al. | |
| 5,575,333 | A | 11/1996 | Lirette et al. | |
| 6,679,325 | B2 | 1/2004 | Buytaert | |
| 7,182,131 | B2 | 2/2007 | Gremillion | |
| 7,673,682 | B2 | 3/2010 | Daily | |
| 7,690,437 | B2 | 4/2010 | Guillot et al. | |
| 7,845,061 | B2 | 12/2010 | Buytaert et al. | |
| 8,196,670 | B2 | 6/2012 | Jenner | |
| 8,505,624 | B2 * | 8/2013 | Levie | 166/241.6 |
| 8,573,296 | B2 * | 11/2013 | Levie | 166/241.1 |
| 8,770,280 | B2 | 7/2014 | Buytaert et al. | |
| 2005/0224123 | A1 | 10/2005 | Baynham et al. | |

(Continued)

FOREIGN PATENT DOCUMENTS

| | | | |
|---|---|---|---|
| WO | 0066874 | A1 | 11/2000 |
| WO | 2013184276 | A2 | 12/2013 |

(Continued)

OTHER PUBLICATIONS

"Specification for Bow-Spring Casing Centralizers," API Specification 10D, 6th Edition, Mar. 2002, pp. 1-24, American Petroleum Institute, Washington, D.C.

(Continued)

*Primary Examiner* — William P Neuder
(74) *Attorney, Agent, or Firm* — John W. Wustenberg; Baker Botts L.L.P.

(57) ABSTRACT

A centralizer system comprising a centralizer disposed about a wellbore tubular, wherein the centralizer comprises, a first body portion, a second body portion, and a plurality of bow springs connecting the first body portion to the second body portion, and a plurality of limit collars coupled to the wellbore tubular between the first body portion and the second body portion, where at least one of the plurality of limit collars is configured to engage the first body portion or the second body portion and pull the centralizer in the direction of travel within the wellbore.

20 Claims, 14 Drawing Sheets

(56) References Cited

U.S. PATENT DOCUMENTS

| | | | | |
|---|---|---|---|---|
| 2007/0131414 | A1 | 6/2007 | Calderoni et al. | |
| 2008/0035331 | A1 | 2/2008 | Buytaert | |
| 2013/0025881 | A1 * | 1/2013 | Buytaert et al. | 166/381 |
| 2013/0319689 | A1 | 12/2013 | Levie et al. | |

FOREIGN PATENT DOCUMENTS

| | | | |
|---|---|---|---|
| WO | 2013184276 | A3 | 12/2013 |
| WO | 2013184277 | A2 | 12/2013 |
| WO | 2013184277 | A3 | 12/2013 |

OTHER PUBLICATIONS

U.S. Patent Application entitled "Improved Limit Collar," by Levie, et al., filed Apr. 25, 2011 as U.S. Appl. No. 13/093,242.

Foreign communication from a related counterpart application—International Search Report and Written Opinion, PCT/US2013/040145, Jun. 18, 2014, 9 pages.

Foreign communication from a related counterpart application—International Search Report and Written Opinion, PCT/US2013/040141, Jun. 18, 2014, 10 pages.

Office Action dated Aug. 14, 2014 (20 pages), U.S. Appl. No. 13/488,069, filed Jun. 4, 2012.

* cited by examiner

PULL THROUGH CENTRALIZER

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Wellbores are sometimes drilled into subterranean formations that contain hydrocarbons to allow recovery of the hydrocarbons. Some wellbore servicing methods employ wellbore tubulars that are lowered into the wellbore for various purposes throughout the life of the wellbore. Since wellbores are not generally perfectly vertical, centralizers are used to maintain the wellbore tubulars aligned within the wellbore. Alignment may help prevent any friction between the wellbore tubular and the side of the wellbore wall or casing, potentially reducing the force required to convey the wellbore tubular within the well in addition to potentially reducing any damage that may occur as the wellbore tubular moves within the wellbore. Common spring centralizers use stop collars located at either end of the centralizer to maintain the centralizer position relative to the wellbore tubular as the tubular is conveyed into and out of the wellbore. The spring centralizer may be free to move within the limits of the stop collars as the stop collars push the centralizer in the direction of motion within the wellbore. Spring centralizers with stop collars are not suitable for all applications within a wellbore and improvements in centralizers may still be made.

SUMMARY

Disclosed herein is a centralizer system comprising a centralizer disposed about a wellbore tubular, wherein the centralizer comprises, a first body portion, a second body portion, and a plurality of bow springs connecting the first body portion to the second body portion, and a plurality of limit collars coupled to the wellbore tubular between the first body portion and the second body portion, where at least one of the plurality of limit collars is configured to engage the first body portion or the second body portion and pull the centralizer in the direction of travel within the wellbore.

Also disclosed herein is a method of centralizing a wellbore tubular comprising conveying a centralizer coupled to a wellbore tubular in a first direction within a wellbore, wherein the centralizer comprises: a first body portion, a second body portion, and a plurality of bow springs connecting the first body portion to the second body portion, wherein the centralizer is coupled to the wellbore tubular by a plurality of limit collars coupled to the wellbore tubular between the first body portion and the second body portion, and wherein the centralizer is pulled in the first direction by an engagement between a first of the plurality of limit collars and the first body portion, and conveying the centralizer in a second direction within the wellbore, wherein the centralizer is pulled in the second direction by an engagement between a second of the plurality of limit collars and the second body portion.

Further disclosed herein is a method of centralizing a wellbore tubular comprising conveying a centralizer coupled to a wellbore tubular in a first direction within a wellbore, and conveying the centralizer in a second direction within the wellbore, wherein the centralizer is limited to a longitudinal translation on the wellbore tubular of less than about 30% of an overall length of the centralizer between being conveyed in the first direction and being conveyed in the second direction.

These and other features will be more clearly understood from the following detailed description taken in conjunction with the accompanying drawings and claims.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1:
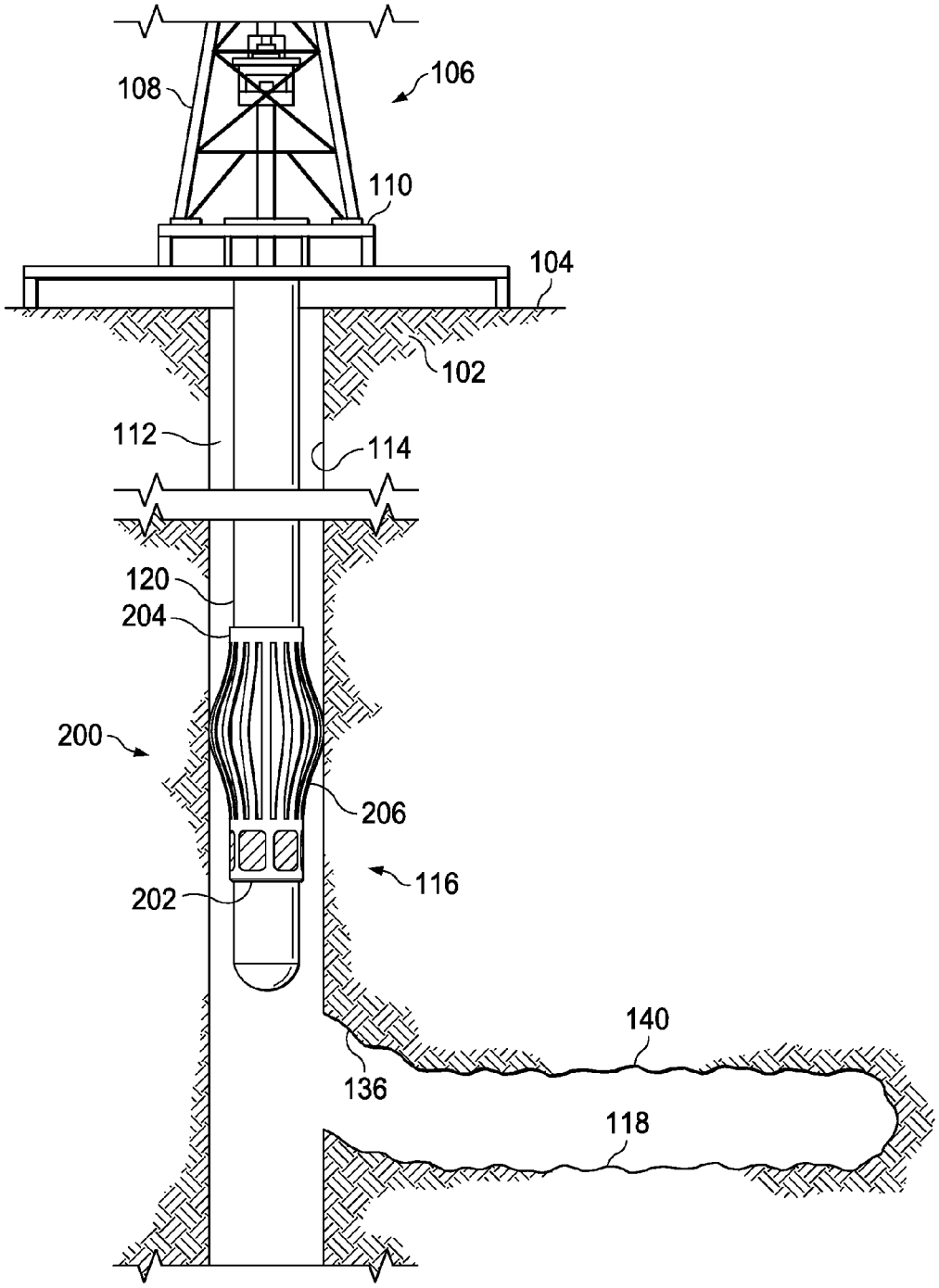
FIG. 1 is a cut-away view of an embodiment of a wellbore servicing system according to an embodiment.

In the drawings and description that follow, like parts are typically marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up," "upper," "upward," or "upstream" meaning toward the surface of the wellbore and with "down," "lower," "downward," or "downstream" meaning toward the terminal end of the well, regardless of the wellbore orientation. Reference to in or out will be made for purposes of description with "in," "inner," or "inward" meaning toward the center or central axis of the wellbore, and with "out," "outer," or "outward" meaning toward the wellbore tubular and/or wall of the wellbore. The various characteristics mentioned above, as well as other features and characteristics described in more detail below, will be readily apparent to those skilled in the art with the aid of this disclosure upon reading the following detailed description of the embodiments, and by referring to the accompanying drawings.

Disclosed herein are centralizers having pull through coupling designs for use with a wellbore tubular. The centralizer described herein may be coupled to a wellbore tubular through the use of one or more windows in a first body portion and a retaining portion disposed within the one or more windows, thereby coupling the centralizer to the wellbore tubular. Additional embodiments include the use of a plurality of limit collars disposed between the first body portion and a second body portion, where at least one of the plurality of limit collars is configured to engage the leading body member in the direction of travel within the wellbore. The use of a pull through coupling design may allow the centralizer to be pulled into the wellbore, rather than being pushed into the wellbore as occurs with traditional centralizers. The ability to pull the centralizer into the wellbore may reduce the starting force associated with the use of the centralizer, offering an advantage over traditional centralizers. Further, the use of the pull through coupling designs rather than traditional stop collars may allow the centralizer of the present disclosure to be used in close tolerance wellbores. Further, the centralizers of the present disclosure may be quickly installed on existing tubing and may not require dedicated subs for their use. The pull through coupling designs may be installed by forming the couplings directly one the wellbore tubular and/or on a body portion when the centralizer is placed on a wellbore tubular, such as an existing section of casing. This production method may allow the centralizer to be installed at the well site or within the oilfield rather than requiring a dedicated manufacturing facility and dedicated subs for attaching the centralizers to a wellbore tubular string. These and other advantages will be apparent in light of the description contained herein.

Referring to FIG. 1, an example of a wellbore operating environment is shown. As depicted, the operating environment comprises a drilling rig 106 that is positioned on the earth's surface 104 and extends over and around a wellbore 114 that penetrates a subterranean formation 102 for the purpose of recovering hydrocarbons. The wellbore 114 may be drilled into the subterranean formation 102 using any suitable drilling technique. The wellbore 114 extends substantially vertically away from the earth's surface 104 over a vertical wellbore portion 116, deviates from vertical relative to the earth's surface 104 over a deviated wellbore portion 136, and transitions to a horizontal wellbore portion 118. In alternative operating environments, all or portions of a wellbore may be vertical, deviated at any suitable angle, horizontal, and/or curved. The wellbore may be a new wellbore, an existing wellbore, a straight wellbore, an extended reach wellbore, a sidetracked wellbore, a multi-lateral wellbore, and other types of wellbores for drilling and completing one or more production zones. Further the wellbore may be used for both producing wells and injection wells. In an embodiment, the wellbore may be used for purposes other than or in addition to hydrocarbon production, such as uses related to geothermal energy.

A wellbore tubular string 120 comprising a centralizer 200 may be lowered into the subterranean formation 102 for a variety of workover or treatment procedures throughout the life of the wellbore. The embodiment shown in FIG. 1 illustrates the wellbore tubular 120 in the form of a casing string being lowered into the subterranean formation. It should be understood that the wellbore tubular 120 comprising a centralizer 200 is equally applicable to any type of wellbore tubular being inserted into a wellbore, including as non-limiting examples drill pipe, production tubing, rod strings, and coiled tubing. The centralizer 200 may also be used to centralize various subs and workover tools. In the embodiment shown in FIG. 1, the wellbore tubular 120 comprising centralizer 200 is conveyed into the subterranean formation 102 in a conventional manner and may subsequently be secured within the wellbore 114 by filling an annulus 112 between the wellbore tubular 120 and the wellbore 114 with cement.

The drilling rig 106 comprises a derrick 108 with a rig floor 110 through which the wellbore tubular 120 extends downward from the drilling rig 106 into the wellbore 114. The drilling rig 106 comprises a motor driven winch and other associated equipment for extending the wellbore tubular 120 into the wellbore 114 to position the wellbore tubular 120 at a selected depth. While the operating environment depicted in FIG. 1 refers to a stationary drilling rig 106 for lowering and setting the wellbore tubular 120 comprising the centralizer 200 within a land-based wellbore 114, in alternative embodiments, mobile workover rigs, wellbore servicing units (such as coiled tubing units), and the like may be used to lower the wellbore tubular 120 comprising the centralizer 200 into a wellbore. It should be understood that a wellbore tubular 120 comprising the centralizer 200 may alternatively be used in other operational environments, such as within an offshore wellbore operational environment.

In alternative operating environments, a vertical, deviated, or horizontal wellbore portion may be cased and cemented and/or portions of the wellbore may be uncased. For example, uncased section 140 may comprise a section of the wellbore 114 ready for being cased with wellbore tubular 120. In an embodiment, a centralizer 200 may be used on production tubing in a cased or uncased wellbore. In an embodiment, a portion of the wellbore 114 may comprise an underreamed section. As used herein, underreaming refers to the enlargement of an existing wellbore below an existing section, which may be cased in some embodiments. An underreamed section may have a larger diameter than a section above the underreamed section. Thus, a wellbore tubular passing down through the wellbore may pass through a smaller diameter passage followed by a larger diameter passage.

Regardless of the type of operational environment the centralizer 200 is used, it will be appreciated that the centralizer 200 serves to aid in guiding the wellbore tubular 120 through the wellbore 114. As described in greater detail below, the centralizer 200 comprises a first body portion 202, a second body portion 204, and a plurality of bow springs 206 connecting the first body portion 202 to the second body portion 204. The centralizer 200 serves to center the wellbore tubular (e.g., casing string 120) within the wellbore 114 as the wellbore tubular 120 is conveyed within the wellbore 114. One or more pull through mechanisms may be used to couple the centralizer 200 to the wellbore tubular 120, and the one or more pull through mechanisms may be configured to allow the centralizer 200 to be pulled into the wellbore and/or in the direction of travel within the wellbore. The centralizer 200 described herein may be used to guide the wellbore tubular 120 through close tolerance restrictions within the wellbore 114. In an embodiment, the centralizer 200 described herein may be used in close tolerance wellbores in which traditional bow spring centralizers using stop collars would not fit.

Several forces are used to characterize centralizers 200. In general, the bow springs 206 provide a force known as a "restoring force" to radially (i.e., laterally) urge the wellbore tubular away from the wall of the wellbore. In an embodiment, the restoring force is directed substantially perpendicular to the wellbore wall. At the same time, the bow springs 206 may be laterally compressible (e.g., in a direction away from the wellbore wall and towards the wellbore tubular wall) so that the wellbore tubular may be moved along the interior of the wellbore notwithstanding the presence in the wellbore of small diameter restrictions and other obstacles to longitudinal movement of the wellbore tubular within the wellbore. Upon encountering a restriction within the wellbore during conveyance, the bow springs may be compressed in order to enter the restriction. The force required to compress the bow springs and insert the centralizer into the interior of the restriction, which may include the initial insertion into the wellbore, is referred to as the "starting force." The contact between the bow springs and the wall of the wellbore may lead to a drag force. The force required to overcome the drag force may be referred to as the "running force," which is the amount of force required to move the wellbore tubular longitudinally along the wellbore with the centralizer affixed to its exterior. Specifications for the amount of restoring force and proper use of centralizers are described in a document entitled, *Specifications for Bow-Spring Centralizers*, API Specification 10D, $6^{th}$ edition, American Petroleum Institute, Washington, D.C. (1994), which is incorporated herein by reference in its entirety. Generally speaking, centralizers are made to center a particular outside diameter (OD) wellbore tubular within a particular nominal diameter wellbore or outer wellbore tubular (e.g., a casing).

Figure 2:
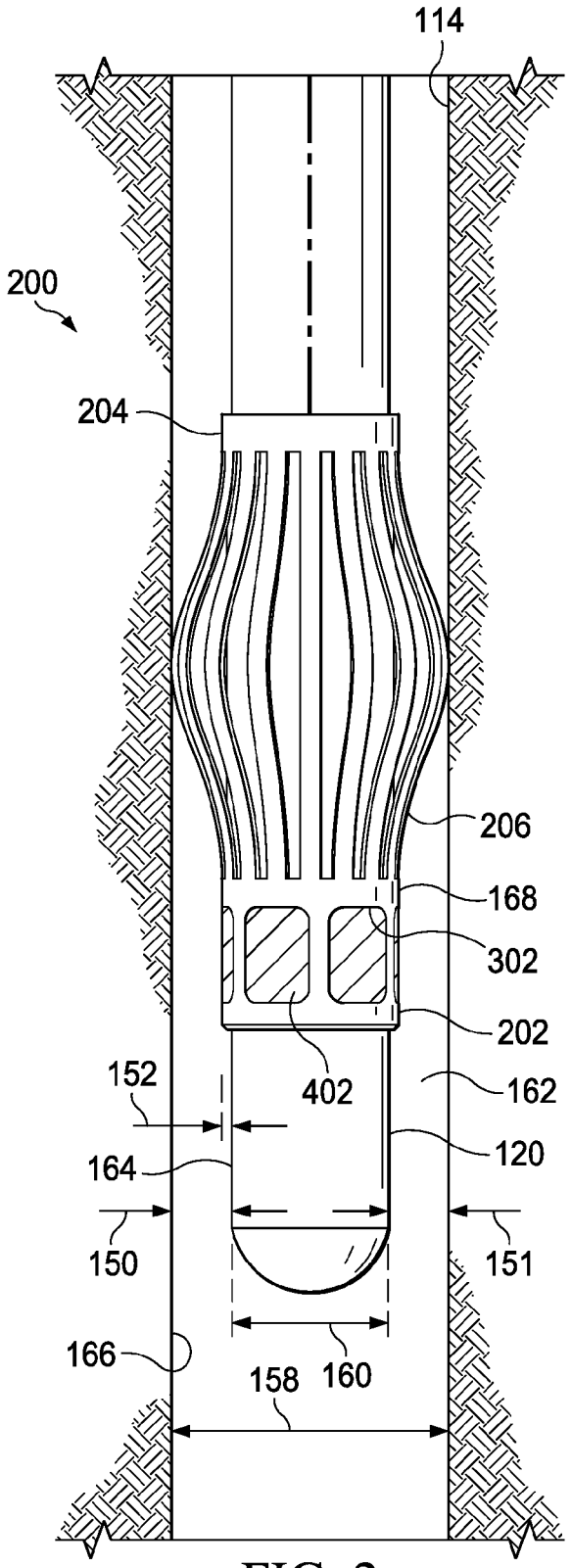
FIG. 2 is a plan view of a centralizer according to an embodiment.

As shown in FIG. 2, the centralizer 200 described herein may be used in a wellbore 114 comprising one or more close tolerance restrictions. A close tolerance restriction generally refers to a restriction in which the inner diameter 158 of the restriction passage is near the outer diameter 160 of a wellbore tubular 120, a tool, or other wellbore apparatus passing through the restriction. The close tolerance restrictions may result from various wellbore designs such as decreasing diameter casing strings, underreamed sections within a wellbore, or collapsed wellbores or casings. For example, passing a smaller diameter casing 120 through a larger diameter casing 162 can create a close tolerance restriction between the outer surface 164 of the smaller diameter casing 120 and the inner surface 166 of the larger diameter casing 162. Examples of casing sizes that may result in close tolerance restrictions within a wellbore 114 are shown in Table 1.

TABLE 1

| Close Tolerance Restrictions Casing Examples | | |
|---|---|---|
| Smaller Diameter Casing Size (inches) | Passing through | Larger Diameter Casing Size (inches) |
| 3.5 | | 4.5 |
| 4.5 | | 5.5 |
| 5 | | 6 |
| 5.5 | | 6 |
| 6.625 | | 7 |
| 7 | | 8.5 |
| 7.625 | | 8.625 |
| 7.75 | | 8.5 |
| 9.625 | | 10.625 |

TABLE 1-continued

| Close Tolerance Restrictions Casing Examples | | |
|---|---|---|
| Smaller Diameter Casing Size (inches) | Passing through | Larger Diameter Casing Size (inches) |
| 9.875 | | 10.625 |
| 10.75 | | 12 |
| 11.875 | | 13.375 |
| 13.375 | | 14.75 |
| 16 | | 17 |
| 20 | | 22 |

The designation of a restriction in a wellbore 114 as a close tolerance restriction may vary depending on a number of factors including, but not limited to, the tolerances allowed in the wellbore, the tortuosity of the wellbore, the need to use flush or near flush connections, the weight of the casing used in the wellbore, the presence of fluid and/or solids in the wellbore, etc. The tolerances allowed in the wellbore may vary from wellbore to wellbore. The term "annular diameter difference" may be used herein to characterize the tolerances in the wellbore 114 and refers to the total width of the annulus (i.e., the sum of annular width 150 and annular width 151) in the close tolerance restriction. The annular diameter difference is calculated as the difference between the inner diameter 158 of the restriction passage and the outer diameter 160 of the wellbore tubular 120 passing through the restriction. In an embodiment, a close tolerance restriction may have an annular diameter difference of about 0.125 inches, about 0.2 inches, about 0.3 inches, about 0.4 inches, about 0.5 inches, about 0.6 inches, about 0.7 inches, about 0.8 inches, about 0.9 inches, about 1.0 inch, about 1.1 inches, about 1.2 inches, about 1.3 inches, about 1.4 inches, or about 1.5 inches. While an upper limit of about 1.5 inches is used, the upper limit may be greater or less than 1.5 inches depending on the other considerations and factors (including for example, a risk/safety factor) for determining if a close tolerance restriction is present in a wellbore. The tortuosity of the wellbore refers to the deviation of the wellbore from a straight hole. A restriction in a wellbore is more likely to be considered a close tolerance restriction as the tortuosity of the wellbore increases. Further, a wellbore tubular with a flush or near flush connection refers to wellbore tubulars without or with only insubstantial upsets along the outer surface, for example at the connections between joints of the wellbore tubulars. The use of flush or near flush connections may create close tolerance restrictions along greater portions of the wellbore tubulars. Finally, the weight of the wellbore tubular may affect both the flexibility of the wellbore tubular string and the annular diameter difference between the wellbore wall or the inner surface 166 of a larger diameter casing string 162, depending on whether the wellbore 114 has been cased, and the outer surface 164 of a smaller diameter casing string 120. The use of premium grade casing and/or premium grade connections may indicate that the difference between inner and outer pipe diameters is small and indicate that a close tolerance restriction exists within the wellbore 114.

Figure 3A:
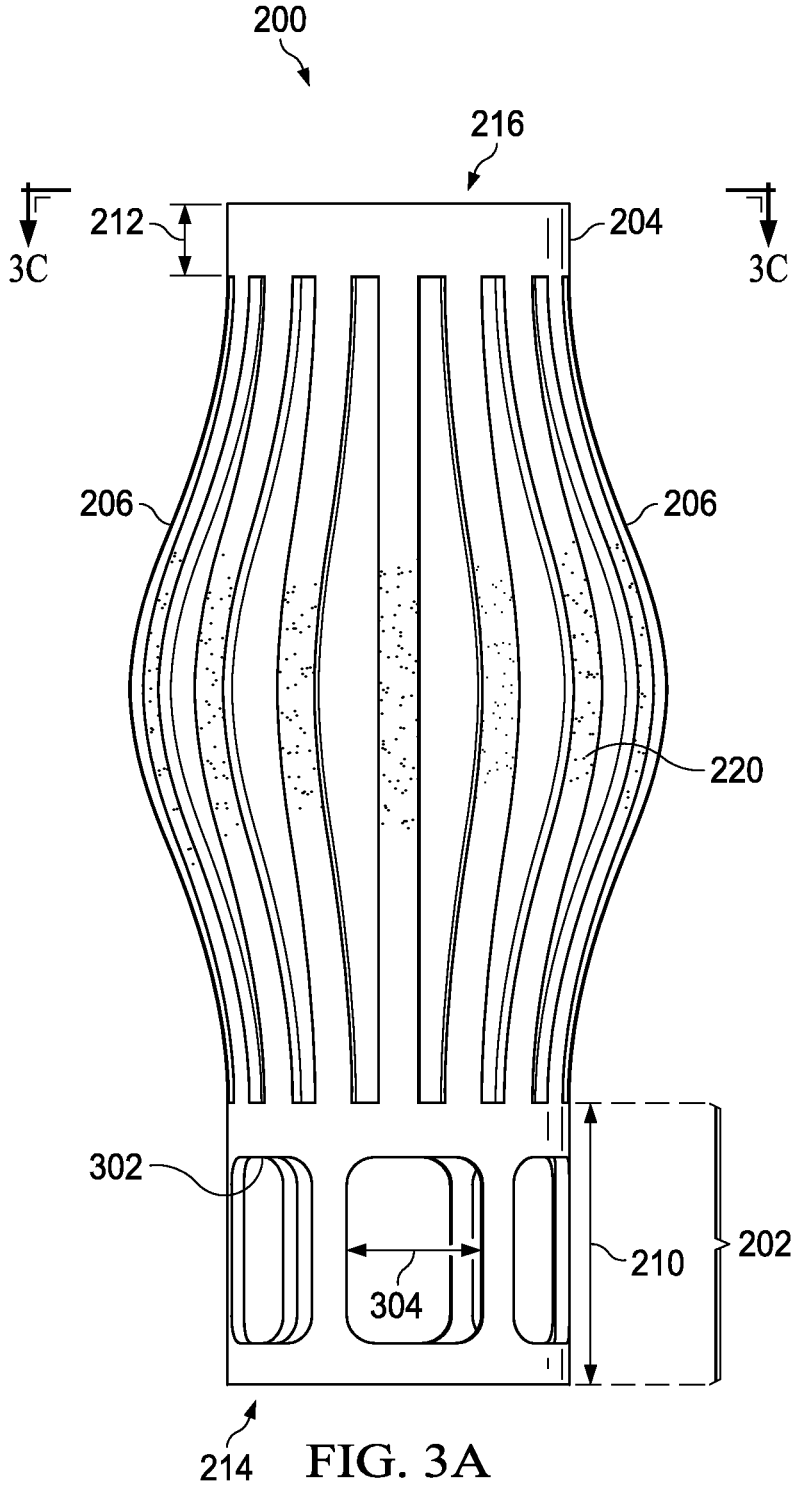
FIG. 3A is a plan view of a centralizer according to another embodiment.
Figure 3B:
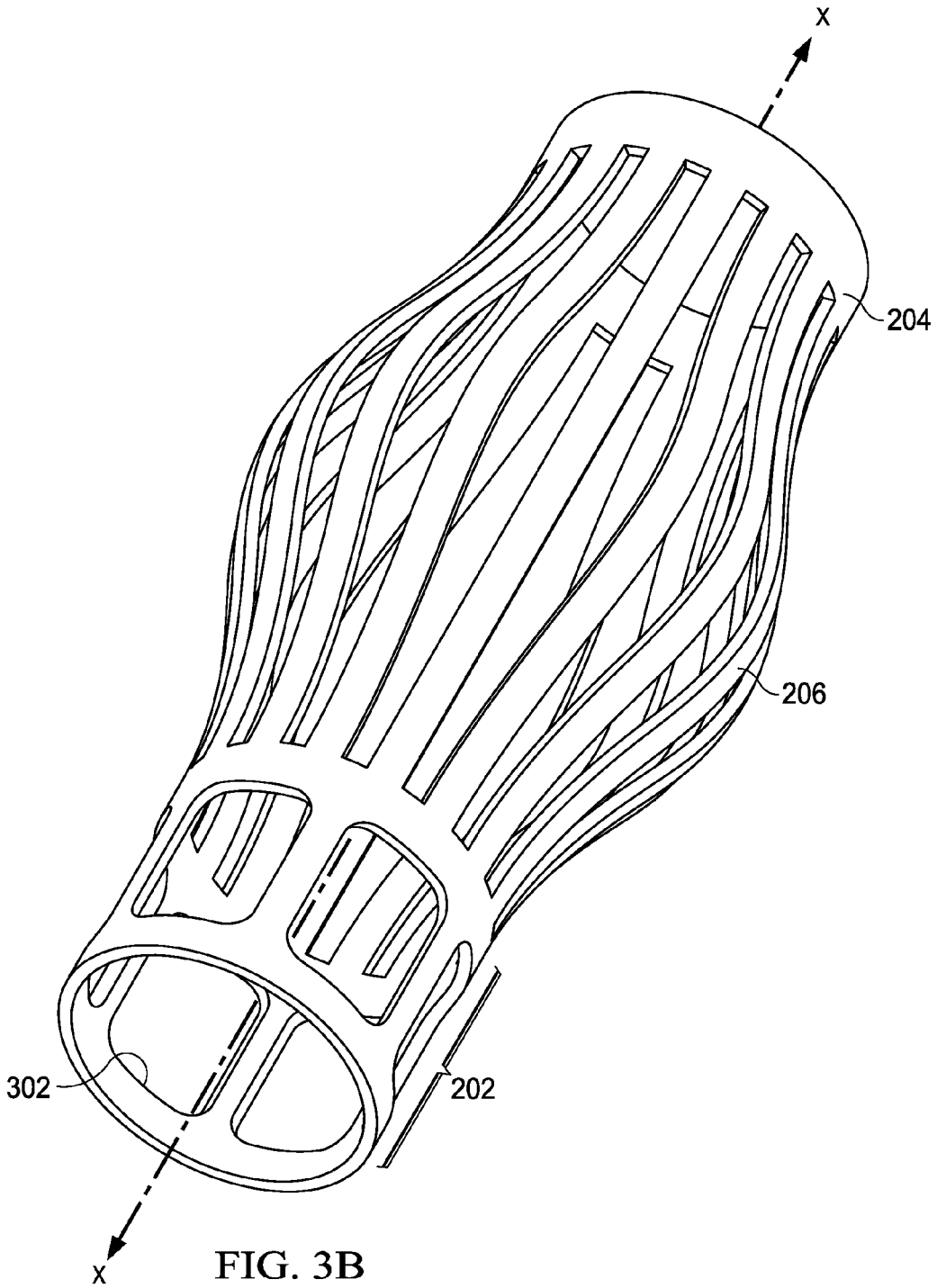
FIG. 3B is a perspective view of a centralizer according to another embodiment.
Figure 3C:
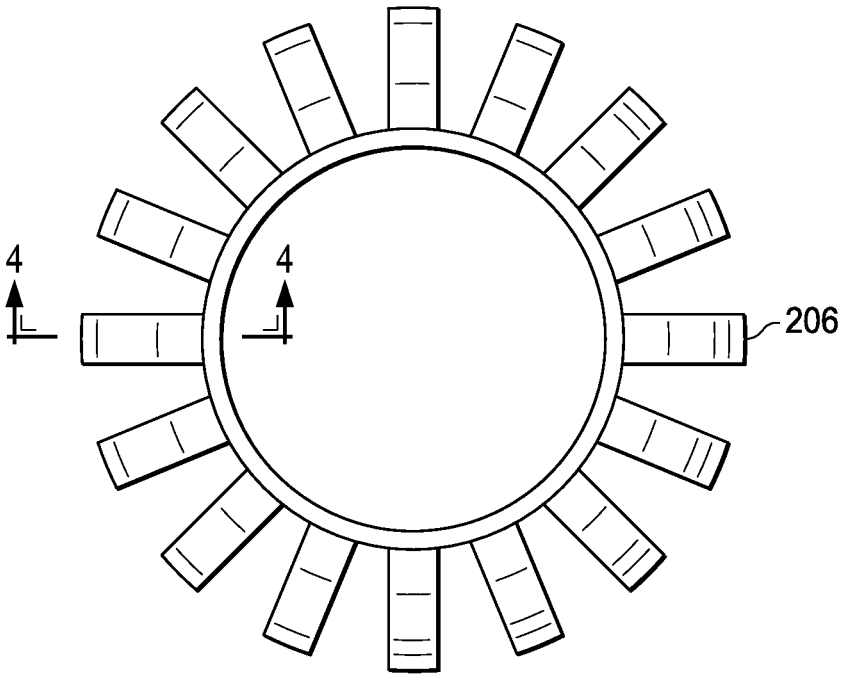
FIG. 3C is a top-down, plan view of a centralizer according to another embodiment.

Referring now to FIGS. 3A, 3B, and 3C, an embodiment of the centralizer 200 is shown in greater detail. As described above, the centralizer 200 comprises a first body portion 202, a second body portion 204, and a plurality of bow springs 206 connecting the first body portion 202 to the second body portion 204. The first body portion 202 and the second body portion 204 may be made from steel, a synthetic material, a composite material, or any other similar high strength material. In an embodiment, the first body portion 202 and the second body portion 204 may be made from a composite material. The first body portion 202 and the second body portion 204 may be generally cylindrical in shape and may have an internal diameter selected to be disposed about the exterior of a wellbore tubular to which they are to be coupled. The first body portion 202 and the second body portion 204 may have a desired length 210, 212 based on the mechanical requirements of the of the centralizer 200 and taking into account the material of construction and the size and shape of the one or more windows 302 disposed in at least the first body portion 202. The one or more windows 302 are described in more detail below. As used herein, the length of the centralizer 200 and/or the one or more bow springs 206 refers to the dimension of the centralizer 200 in the longitudinal direction (e.g., along axis X of FIG. 3B) of the wellbore tubular 120, and the width of the centralizer 200 and/or the one or more bow springs 206 refers to the dimension in a direction perpendicular to the longitudinal direction of the wellbore tubular 120 along the surface of the wellbore tubular 120. In an embodiment the length 210 of the first body portion 202 and the length 212 of the second body portion 204 may be the same or different.

The leading and/or trailing edges 214, 216 of the first body portion 202 and/or the second body portion 204, respectively, may be tapered or angled to aid in movement of the centralizer 200 through the wellbore (e.g., through a restriction and/or upon entering the wellbore). In an embodiment, when optional guide collars are used to maintain the centralizer 200 in position on the wellbore tubular, the leading and/or trailing edges of the guide collars may be tapered, and/or the leading and/or trailing edges 214, 216 may not be tapered.

A plurality of bow springs 206 may be coupled to and connect the body portions 202, 204. The bow springs 206 may be formed from a material comprising the same components as the first body portion 202 and/or the second body portion 204, or different materials from the first body portion 202 and/or the second body portion 204. In an embodiment, one or more of the bow springs may be formed from steel (e.g., spring steel) or a similar high strength material. Two or more bow springs 206 may be used to couple the body portions 202, 204. The number of bow springs 206 may be chosen based on the wellbore tubular properties (e.g., weight, size), the wellbore properties (e.g., orientation, tortuosity, etc.), the wellbore service conditions (e.g., temperature, acidity, etc.) and/or the annular diameter difference. The number of bow springs 206 may also be chosen to reduce the starting and/or drag forces while increasing the restoring force available within the wellbore. The bow springs 206 may generally extend longitudinally between the body portions 202, 204. However, additional orientations may be used depending on the desired use of the centralizer. For example, helical and/or angled orientations may also be possible. Each of the bow springs 206 may comprise the same materials and orientation. In an embodiment, each bow spring 206 or any combination of the plurality of bow springs 206 may comprise different materials and/or orientations.

The bow springs 206 may be coupled to the first body portion 202 and the second body portion 204 using any means known in the art. For example, the bow springs 206 may be welded, brazed, diffusion bonded, connected using a connector, and/or integrally formed along with the first body portion 202 and the second body portion 204. In an embodiment, the bow springs 206 may be rotatably coupled to the first body portion 202 and/or the second body portion 204. In this embodiment, any type of connection allowing for relative movement may be used to connect the bow springs 206 to the first body portion 202 and/or the second body portion 204. For example, the bow springs 206 may be connected to the first body portion 202 and/or the second body portion 204 using an interlocking sleeve. The interlocking sleeve may comprise a race disposed on the first body portion 202 and/or the second body portion 204 and a corresponding interlocking track disposed on each of the plurality of bow springs 206. In an embodiment, the plurality of bow springs 206 may be connected to a body portion that has an interlocking track capable of interlocking with a race disposed on the body portion having the retaining portion disposed in one or more windows thereof. In an embodiment, one or more bow springs 206 and/or an interlocking collar may be used with the first body portion 202, the second body portion 204, and/or any of a plurality of body portions disposed between the first body portion 202 and the second body portion 204. The ability for the bow springs 206 to rotate about a longitudinal axis with respect to the first body portion 202 and/or the second body portion 204, and thus rotate with respect to the wellbore tubular 120, may help prevent damage to the bow springs 206 upon a rotation of the wellbore tubular in the wellbore (e.g., may help prevent the bending of a bow spring, the breaking of a bow spring off of the centralizer, etc.).

The bow springs 206 may generally have an arced profile between the body portions 202, 204, though any suitable shape (e.g., recurved) imparting a standoff from the wellbore tubular and/or a desired restoring force may be used. In an embodiment, the bow springs 206 may have a smooth arc between the body portions 202, 204. In an embodiment, the bow springs 206 may have a multi-step design. In this embodiment, the bow springs 206 may generally have a first arced section between the body portions 202, 204 and a second arced section disposed along the length of the bow spring 206 between the body portions 202, 204. The first and/or second arced sections may be formed in a variety of shapes, (e.g., an arc of increased angle, a sinusoidal curve, etc.). As a result of the multi-step design, the restoring force may increase in steps as the bow spring 206 is displaced in a radial direction towards the center of the centralizer 200. The initial displacement may occur as a result of the flexing of a larger arced section (e.g., a first arced section). Additional inward displacement may cause a second arced section to flex and present a greater restoring force. In an embodiment, a plurality of arced sections could be implemented along a bow spring 206 to create a restoring force profile as desired. In an embodiment, each of the bow springs 206 may comprise the same shape. In another embodiment, each bow spring 206 or any combination of the plurality of bow springs 206 may comprise different shapes.

The restoring force may also be tailored based on additional considerations including, but not limited to, the thickness of a bow spring 206 and/or the width of a bow spring 206. A bow spring 206 may have a uniform thickness along the length of the bow spring, or the thickness may vary along the length of the bow spring 206. The thickness of the bow spring 206 may be substantially uniform along the length of the bow spring 206. As used herein, "substantially uniform" refers to a thickness that may vary within the manufacturing tolerances of the component. In an embodiment, the thickness of each arced section may be greater than, less than, or the same as the thickness of any other arced section. In general, the restoring force may increase as the thickness of the bow spring 206 increases. Similarly, the restoring force may increase as the width of the bow spring increases. The thickness, width, and length may be limited based upon the characteristics of the wellbore tubular and the wellbore into which the centralizer is disposed. Further design factors that may affect the restoring force, the starting force, and the running force may include, but are not limited to, the type of materials used to form the bow springs (e.g., steel, a composite, etc.). In an embodiment in which a composite material is used to form the bow springs 206, design factors may include the type of fiber or fibers used in forming the bow springs 206, and/or the type of matrix material or materials used to form the bow springs 206, each of which are discussed in more detail below. Still further design factors may include the angle of winding of the fibers and the thickness of the fibers.

In an embodiment in which the bow springs 206 are formed from a composite material, the bow springs 206 may have a plurality of particulates 220 disposed on the outer surface of the bow springs 206. As used herein, the "outer surface" of the bow springs 206 comprises those portions of the bow springs 206 anticipated to contact a surface of a wellbore and/or tubular into which the centralizer 200 is placed. The particulates 220 may be disposed along the entire length of the bow springs 206 or only those portions anticipated to contact the wellbore wall during conveyance of the centralizer 200 and wellbore tubular within the wellbore. As used herein, disposed on the outer surface generally refers to the particulates 220 being located at the outer surface of the bow springs 206 and may include the particulates 220 being embedded in the outer surface, deposited in and/or on the outer surface, and/or coated on the outer surface. The particulates may generally be resistant to erosion and/or abrasion to prevent wear on the points of contact between the bow spring surfaces and the wellbore walls or inner surfaces of the wellbore. The shape, size, and composition of the particulates may be selected to affect the amount of friction between the bow springs 206 and the wellbore walls during conveyance of the wellbore tubular comprising the centralizer 200 within the wellbore. In general, the particulates 220 may be selected to reduce the running forces required during conveyance of the wellbore tubular within the wellbore. In an embodiment, the particulates 220 may comprise a low surface energy and or coefficient of friction, and/or may comprise substantially spherical particles. The particulates 220 may have a distribution of sizes, or they may all be approximately the same size. In an embodiment, the particulates may be within a distribution of sizes ranging from about 0.001 inches to about 0.2 inches, 0.005 inches to about 0.1 inches, 0.01 inches to about 0.005 inches. In an embodiment, the particulates may be about 0.02 inches to about 0.004 inches. The particulates 220 may comprise any material capable of resisting abrasion and erosion when disposed on a bow spring 200 and contacted with the wellbore wall. In an embodiment, the particulates 220 may be formed from metal and/or ceramic. For example, the particulates 220 may comprise zirconium oxide. In an embodiment, the particulates 220 may be coated with any of the surface coating agents discussed below to aid in bonding between the particulates 220 and one or more materials of construction of the centralizer 200 or any centralizer components.

In an embodiment, the first body portion 202, the second body portion 204, and/or one or more bow springs 206 may be formed from one or more composite materials. A composite material comprises a heterogeneous combination of two or more components that differ in form or composition on a macroscopic scale. While the composite material may exhibit characteristics that neither component possesses alone, the components retain their unique physical and chemical identities within the composite. Composite materials may include a reinforcing agent and a matrix material. In a fiber-based composite, fibers may act as the reinforcing agent. The matrix material may act to keep the fibers in a desired location and orientation and also serve as a load-transfer medium between fibers within the composite.

The matrix material may comprise a resin component, which may be used to form a resin matrix. Suitable resin matrix materials that may be used in the composite materials described herein may include, but are not limited to, thermosetting resins including orthophthalic polyesters, isophthalic polyesters, phthalic/maelic type polyesters, vinyl esters, thermosetting epoxies, phenolics, cyanates, bismaleimides, nadic end-capped polyimides (e.g., PMR-15), and any combinations thereof. Additional resin matrix materials may include thermoplastic resins including polysulfones, polyamides, polycarbonates, polyphenylene oxides, polysulfides, polyether ether ketones, polyether sulfones, polyamide-imides, polyetherimides, polyimides, polyarylates, liquid crystalline polyester, polyurethanes, polyureas, and any combinations thereof.

In an embodiment, the matrix material may comprise a two-component resin composition. Suitable two-component resin materials may include a hardenable resin and a hardening agent that, when combined, react to form a cured resin matrix material. Suitable hardenable resins that may be used include, but are not limited to, organic resins such as bisphenol A diglycidyl ether resins, butoxymethyl butyl glycidyl ether resins, bisphenol A-epichlorohydrin resins, bisphenol F resins, polyepoxide resins, novolak resins, polyester resins, phenol-aldehyde resins, urea-aldehyde resins, furan resins, urethane resins, glycidyl ether resins, other epoxide resins, and any combinations thereof. Suitable hardening agents that can be used include, but are not limited to, cyclo-aliphatic amines; aromatic amines; aliphatic amines; imidazole; pyrazole; pyrazine; pyrimidine; pyridazine; 1H-indazole; purine; phthalazine; naphthyridine; quinoxaline; quinazoline; phenazine; imidazolidine; cinnoline; imidazoline; 1,3,5-triazine; thiazole; pteridine; indazole; amines; polyamines; amides; polyamides; 2-ethyl-4-methyl imidazole; and any combinations thereof. In an embodiment, one or more additional components may be added the matrix material to affect the properties of the matrix material. For example, one or more elastomeric components (e.g., nitrile rubber) may be added to increase the flexibility of the resulting matrix material.

The fibers may lend their characteristic properties, including their strength-related properties, to the composite. Fibers useful in the composite materials used to form a body portion and/or one or more bow springs may include, but are not limited to, glass fibers (e.g., e-glass, A-glass, E-CR-glass, C-glass, D-glass, R-glass, and/or S-glass), cellulosic fibers (e.g., viscose rayon, cotton, etc.), carbon fibers, graphite fibers, metal fibers (e.g., steel, aluminum, etc.), ceramic fibers, metallic-ceramic fibers, aramid fibers, and any combinations thereof.

The strength of the interface between the fibers and the matrix material may be modified or enhanced through the use of a surface coating agent. The surface coating agent may provide a physico-chemical link between the fiber and the resin matrix material, and thus may have an impact on the mechanical and chemical properties of the final composite. The surface coating agent may be applied to fibers during their manufacture or any other time prior to the formation of the composite material. Suitable surface coating agents may include, but are not limited to, surfactants, anti-static agents, lubricants, silazane, siloxanes, alkoxysilanes, aminosilanes, silanes, silanols, polyvinyl alcohol, and any combinations thereof.

A centralizer comprising a composite material used to form one or more body portions and/or bow springs may be formed using any techniques known for forming a composite material into a desired shape. The fibers used in the process may be supplied in any of a number of available forms. For example, the fibers may be supplied as individual filaments wound on bobbins, yarns comprising a plurality of fibers wound together, tows, rovings, tapes, fabrics, other fiber broadgoods, or any combinations thereof. The fiber may pass through any number rollers, tensioners, or other standard elements to aid in guiding the fiber through the process to a resin bath.

In an embodiment, the formation process may begin with a fiber being delivered to a resin bath. The resin may comprise any resin or combination of resins known in the art, including those listed herein for the specific portions of the centralizer. The resin bath can be implemented in a variety of ways. For example, the resin bath may comprise a doctor blade roller bath wherein a polished rotating cylinder that is disposed in the bath picks up resin as it turns. The doctor bar presses against the cylinder to obtain a precise resin film thickness on cylinder and pushes excess resin back into the bath. As the fiber passes over the top of the cylinder and is in contact with the cylinder, the fiber may contact the resin film and wet out. In another embodiment, resin bath may comprise an immersion bath where the fiber is partially or wholly submerged into the resin and then pulled through a set of wipers or rollers that remove excess resin.

After leaving the resin bath, the resin-wetted fiber may pass through various rings, eyelets, and/or combs to direct the resin-wetted fiber to a mandrel to form one or more bow springs. The fibers may be wound onto the mandrel to form the base for the one or more bow springs using an automated process that may allow for control of the direction of the winding and the winding pattern. The winding process may determine the thickness profile of the bow springs in the formation process. Without intending to be limited by theory, it is expected that the winding pattern and orientation of the fibers may determine the degree of flexibility of the bow springs. In an embodiment, particulates, which may comprise a surface coating agent, may be disposed on the outer surface of the bow springs after the fibers leave the resin bath and/or when disposed on the mandrel.

The wound fibers may be allowed to harden or set to a desired degree on the mandrel before being cut and removed from the mandrel as a mat. The mat may then be divided into strips of a desired dimension to initially form the one or more bow springs. For the bow springs, the strips may be placed in a shaped mold to cure in a desired shape. In an embodiment, the mold may comprise a two-piece block mold in which one or more of the strips are placed and formed into a desired shape due to the form of the two piece mold. The particulates, which may comprise a surface coating agent, may be disposed on the outer surface of the bow springs when the bow springs are placed in the mold. The mold may then be heated to heat cure the resin to a final, cured state. In another embodiment, other curing techniques may be used to cause the strips to harden to a final, cured state. After completing the curing process, the mold may be disassembled and the bow springs removed.

One or more body portions may then be prepared according to a similar process. The fiber and/or combination of fibers used to form one or more body portions may be passed through a resin bath as described above. The resin-wetted fibers may then be wound onto a cylindrical mandrel of a desired shape, which may be the same or different than the cylindrical mandrel used to form the bow springs. In an embodiment, the cylindrical mandrel upon which the resin-wetted body portion fibers are wound may have a diameter approximately the same as the diameter of a wellbore tubular upon which the final centralizer is to be disposed. The fibers may be wound onto the cylindrical mandrel to form a portion of the body portion using an automated process that may allow for control of the direction of the winding and the winding pattern. After winding a portion of the resin-wetted body portion fibers onto the cylindrical mandrels, the bow springs may be placed onto the cylindrical mandrel in the desired positions. The bow springs may be held in place using temporary restraining means (e.g., tape), or the resin used on the body portion fibers may be sufficiently tacky to hold the bow springs in place during the remainder of the manufacturing process.

Additional resin-wetted body portion fibers may then be wound onto the cylindrical mandrel, at least a portion of which may be placed on top of the ends of the bow springs. In this manner, the bow springs may be integrally formed into the body portions. The fibers may be wound onto the cylindrical mandrel to form the remainder of the body portions using an automated process that may allow for control of the direction of the winding and the winding pattern. The formed centralizer may then be cured to produce a final, cured state in the body portions, the bow springs. In an embodiment, a heat cycle may be used to thermally cure a thermally curable resin, and/or any other number of curing processes may be used to cure an alternative or additional resin used in the formation of the composite centralizer. The cylindrical mandrel may then be pressed out of the centralizer. In an embodiment, the centralizer may then be disposed about a wellbore tubular and secured in place using any of the methods disclosed herein.

The winding process used to form the body portions and/or the bow springs may determine the direction of the fibers and the thickness of the body portions and/or the bow springs. The ability to control the direction and pattern of winding may allow for the properties of the completed centralizer and/or centralizer components to possess direction properties. In an embodiment, the direction of the fibers in the body portions may be different than the direction of the fibers in the bow springs. In an embodiment, the fibers in the body portions may generally be aligned in a circumferential direction, and the fibers in the bow springs may generally be aligned along the longitudinal axis of the centralizer.

In an embodiment, the centralizer formation process may be designed by and/or controlled by an automated process, which may be implemented as software operating on a processor. The automated process may consider various desired properties of the centralizer as inputs and calculate a design of the centralizer based on the properties of the available materials and the available manufacturing processes. In an embodiment, the automated process may consider various properties of the materials available for use in the construction of the centralizer including, but not limited to, the diameter, stiffness, moduli, and cost of the fibers. The desired properties of the centralizer may comprise the geometry of the centralizer, the restoring force, the running force, the starting force, and any other specific considerations such as a desired choice of materials. The use of the automated process may allow for centralizers to be designed for specific uses and allow the most cost effective design to be chosen at the time of manufacture. Thus, the ability to tailor the design of the centralizer to provide a desired set of properties may offer an advantage of the centralizer and methods disclosed herein.

While discussed in terms of an entirely composite centralizer, the formation process described herein may also apply if one or more of the components were formed from a material other than a composite material. For example, if the bow springs comprised only a metallic material, the bow springs can be integrally formed with a composite body portion during the formation process. In addition to the process described herein, other suitable formation processes for the centralizer may be used.

The centralizer may be coupled to the wellbore tubular using a configuration to allow the centralizer to be pulled in at least one direction of travel within the wellbore. In an embodiment, the centralizer described herein may be coupled to a wellbore tubular through the use of one or more windows in a first body portion and a retaining portion disposed within the one or more windows, thereby coupling the centralizer to the wellbore tubular. In another embodiment the centralizer may be coupled to a wellbore tubular using of a plurality of limit collars disposed between a first body portion and a second body portion, where at least one of the plurality of limit collars is configured to engage the leading body member in the direction of travel within the wellbore.

In an embodiment, the centralizer may be coupled to a wellbore tubular through the use of a retaining portion disposed in the one or more windows in a body portion. As shown in FIGS. 3A and 3B, at least one window 302 may be disposed in the first body portion 202. The wellbore tubular may be longitudinally disposed within the centralizer 200. The window 302 disposed in the first body portion 202 may comprise a cutout of the first body portion 202 that allows for access through the first body portion 202. A retaining portion may be disposed within the window 302 to couple the centralizer 200 to the wellbore tubular, as described in more detail herein. The window 302 may comprise any shape including, but not limited to, square, rectangular, and oval. When the window has a shape with corners, the corners may be rounded to prevent the formation of a stress concentration during use. For example, when a rectangular window is used, the interior corners of the window may be rounded. The size of the windows may be chosen to allow for the creation of a retaining portion of sufficient size to maintain the mechanical coupling between the centralizer 200 and the wellbore tubular 120. In an embodiment, the first body portion 202 may comprise a plurality of windows 302. In an embodiment, both the first body portion 202 and the second body portion 204 may comprise one or more windows 302, and one of the first body portion 202 or the second body portion 204 may have the retaining portion disposed within the windows to couple the centralizer 200 to the wellbore tubular at the first body portion 202 or the second body portion 204.

Figure 4A:
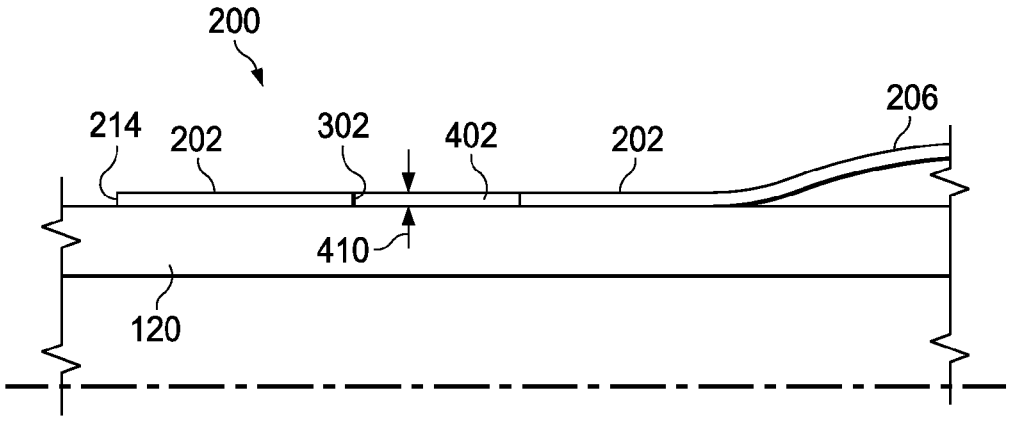
FIGS. 4A-4C are partial cross-sectional views of embodiments of a centralizer.
Figure 4B:
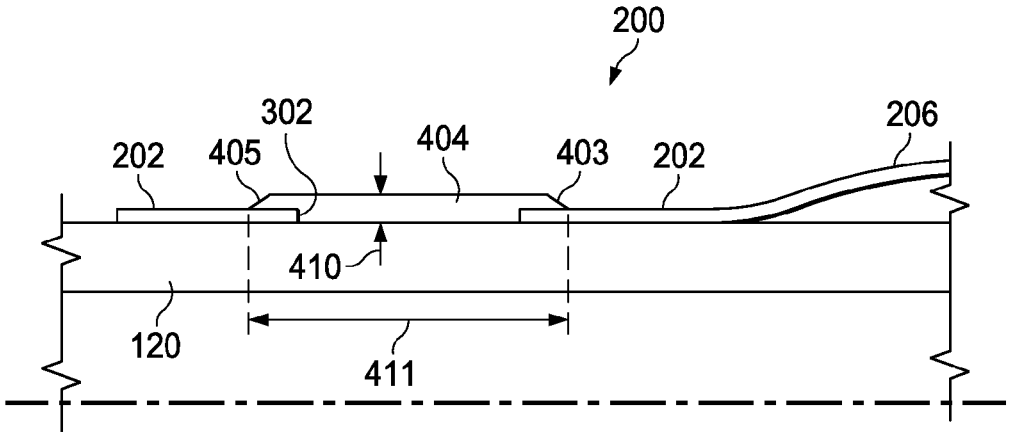
Figure 4C:
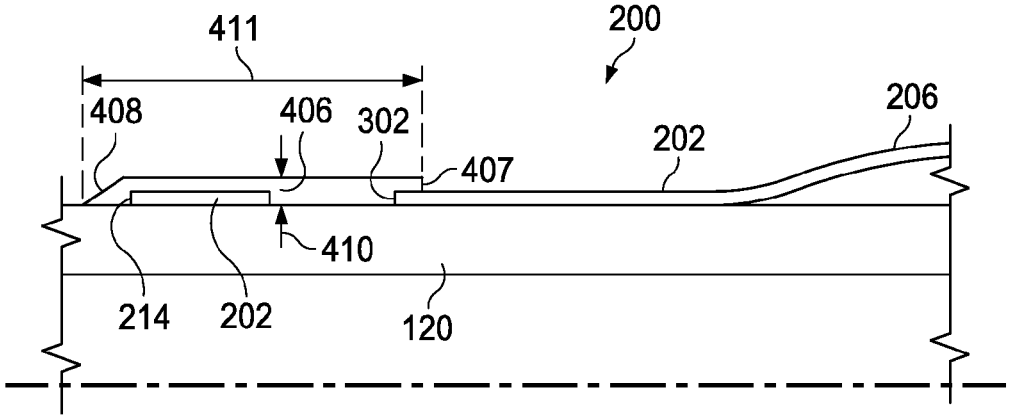

FIGS. 4A-4C illustrate half cross sections taken along line 4-4 of FIG. 3C. As illustrated in FIGS. 4A-4C, a retaining portion 402 may be disposed within the window 302 to provide the mechanical force to couple the centralizer 200 to the wellbore tubular 120. The retaining portion 402 may generally have a shape corresponding and/or complimentary to the shape of the window 302 within which it is disposed, and the retaining portion 402 may substantially fill the window 302 within which it is disposed. The mechanical holding force between the retaining portion and the wellbore tubular may be based, at least in part, on the total surface area between the retaining portion and the wellbore tubular 120, the height of the retaining portion 402, and the composition of the retaining portion 402. Similarly, the mechanical holding force between the retaining portion and the centralizer may be based, at least in part, on the area available for interaction between the retaining portion and the centralizer, and the composition of the retaining portion 402. The area available for interaction may generally include the edges of the windows 302 as well as any surface area on the outer diameter and/or inner diameter of the body portion within which the window 302 is disposed. Thus, the geometry of the retaining portion and the window 302 may both affect the mechanical holding force between the retaining portion and the centralizer 200. For example, when a composite material is used to form the retaining portion, the total surface area between the composite material and the wellbore tubular 120 may determine the bonding strength of the retaining portion to the wellbore tubular 120. In an embodiment, the retaining portion may be disposed in less than all of the windows in the first body portion 202. The number of windows within which the retaining portion is disposed and the design of the retaining portion may be based on the considerations of the retaining force needed and the geometry of the retaining portion and one or more of the windows.

The sides of the retaining portion and the window 302 may be substantially perpendicular to the longitudinal axis of the centralizer 200 to allow for an interaction between the surfaces over a broader surface area and to allow the force imparted on the retaining portion to be substantially tangential to the surface of the wellbore tubular 120. As used herein, the height 410 of the retaining portion 402 refers to the standoff distance of the retaining portion 402 from the wellbore tubular 120, the length 411 of the retaining portion 402 refers to the dimension of the retaining portion 402 in the longitudinal direction of the wellbore tubular 120, and the width (e.g., distance 304 of FIG. 3A) of the retaining portion refers to the dimension of the retaining portion in a direction perpendicular to the longitudinal direction of the wellbore tubular 120.

In an embodiment, the retaining portion 402 is configured to substantially fixedly couple the body portion 202 of the centralizer 200 comprising one or more windows 302 to the wellbore tubular 120. The shape and size of the retaining portion 402 may vary while still effectively coupling a body portion of the centralizer 200 to the wellbore tubular 120. The fixed coupling of a body portion of the centralizer 200 to the wellbore tubular 120 may limit the longitudinal movement of the centralizer 200 with respect to the wellbore tubular 120. While the additional body portion (e.g., the second body portion 204) or portions may be free to move relative to the wellbore tubular 120, the overall movement of the centralizer 200 may be advantageously limited relative to a centralizer being maintained in position with traditional collar stops. In some embodiments, the bow springs 206 and additional body portions may be free to rotate about the longitudinal axis, and the fixed engagement between the first body portion 202 and the wellbore tubular 120 may refer to limiting the longitudinal movement of the centralizer 200. In general, the size of the retaining portion 402 may be chosen based on the material and method of forming the retaining portion and may generally be sized to substantially fill the window 302 within which it is disposed. As shown in FIG. 4A, the retaining portion 402 may be disposed within one or more of the windows 302 and have a height substantially the same as the first body portion 202. The retaining portion 402 may comprise a composite material that is formed within the window 302 and substantially fills the one or more windows 302. The retaining portion 402 may be coupled to the wellbore tubular 120, thereby coupling the first body portion 202 to the wellbore tubular 120. As described in more detail below, the formation process may result in some amount of the retaining portion material being disposed between the first body portion 202 and the wellbore tubular 120. This material may help to further couple the centralizer 200 to the wellbore tubular 120.

In an embodiment illustrated in FIG. 4B, the retaining portion 404 may be disposed within the window 302 and have a height 410 greater than the height of the first body portion 202. The length 411 of the retaining portion 404 may be greater than the length of the window 302, resulting in the retaining portion 404 overlapping the outer surface of the first body portion 202. In an embodiment, one or more edges 403, 405 of the retaining portion 404 may be tapered to aid in aligning the centralizer within the wellbore, for example when entering a close tolerance restriction. The retaining portion 404 may be coupled to the wellbore tubular 120, thereby coupling the first body portion 202 to the wellbore tubular 120. As with the embodiment shown in FIG. 4A, the formation process may result in some amount of the retaining portion material being disposed between the first body portion 202 and the wellbore tubular 120. This material may help to further couple the centralizer 200 to the wellbore tubular 120.

In an embodiment illustrated in FIG. 4C, the retaining portion 406 may be disposed within the window 302 and have a height 410 greater than the height of the first body portion 202. The length 411 of the retaining portion 406 may be greater than the length of the window 302 and extend past the end of the first body portion 202. In an embodiment, one or more edges 407, 408 of the retaining portion 406 may be tapered to aid in aligning the centralizer within the wellbore, for example when entering a close tolerance restriction. The retaining portion 406 may be coupled to the wellbore tubular 120 at both the area within the window 302 and the area at or near the end 214 of the first body portion 202, thereby coupling the first body portion 202 to the wellbore tubular 120. As with the embodiment shown in FIG. 4A, the formation process may result in some amount of the retaining portion material being disposed between the first body portion 202 and the wellbore tubular 120, which may further couple the centralizer 200 to the wellbore tubular 120.

Referring to FIG. 2, the height 152 of the first body portion 202, the second body portion 204, the retaining portion 402, and/or any optional guide collars may vary depending on the width of the annulus available between the wellbore tubular 120 and the side of the wellbore 114 or the inner surface 166 of the casing, depending on whether or not the wellbore 114 has been cased. Due to the tolerances available within a wellbore 114, a well operator may specify a minimum tolerance for the space between the outermost surface 168 of a wellbore tubular 120, including the centralizer 200, and the inner surface 166 of the wellbore 114 or the casing 162 disposed within the wellbore. Using the tolerance, the height of the first body portion 202, the second body portion 204, the retaining portion 402, and/or any optional guide collars may be less than the annular diameter difference minus the tolerance set by the well operator. In an embodiment, the tolerance may be about 0.1 inches to about 0.2 inches. In an embodiment, no tolerance may be allowed other than the pipe manufacturer's tolerances, which may be based on industry standards (e.g., American Petroleum Institute (API) standards applicable to the production of a wellbore tubular), of about 1% based on the outer diameter of the wellbore tubular 120 and the drift tolerance of the inner diameter of the close tolerance restriction present in the wellbore (e.g., a casing through which the wellbore tubular comprising the centralizer passes). The minimum height of the first body portion 202, the second body portion 204, the retaining portion 402, and/or any optional guide collars may be determined based on the structural and mechanical properties of the first body portion 202, the second body portion 204, the retaining portion 402, and/or any optional guide collars. The height of each of the first body portion 202, the second body portion 204, the retaining portion 402, and any optional guide collars may the same or different. The height of the corresponding retaining portion 402 and body portion pair may generally be similar to allow for a sufficient interference between the retaining portion 402 and the edge of the window 302 in the body portion 202 to apply the required force to pull the centralizer 200 into the wellbore.

Figure 5A:
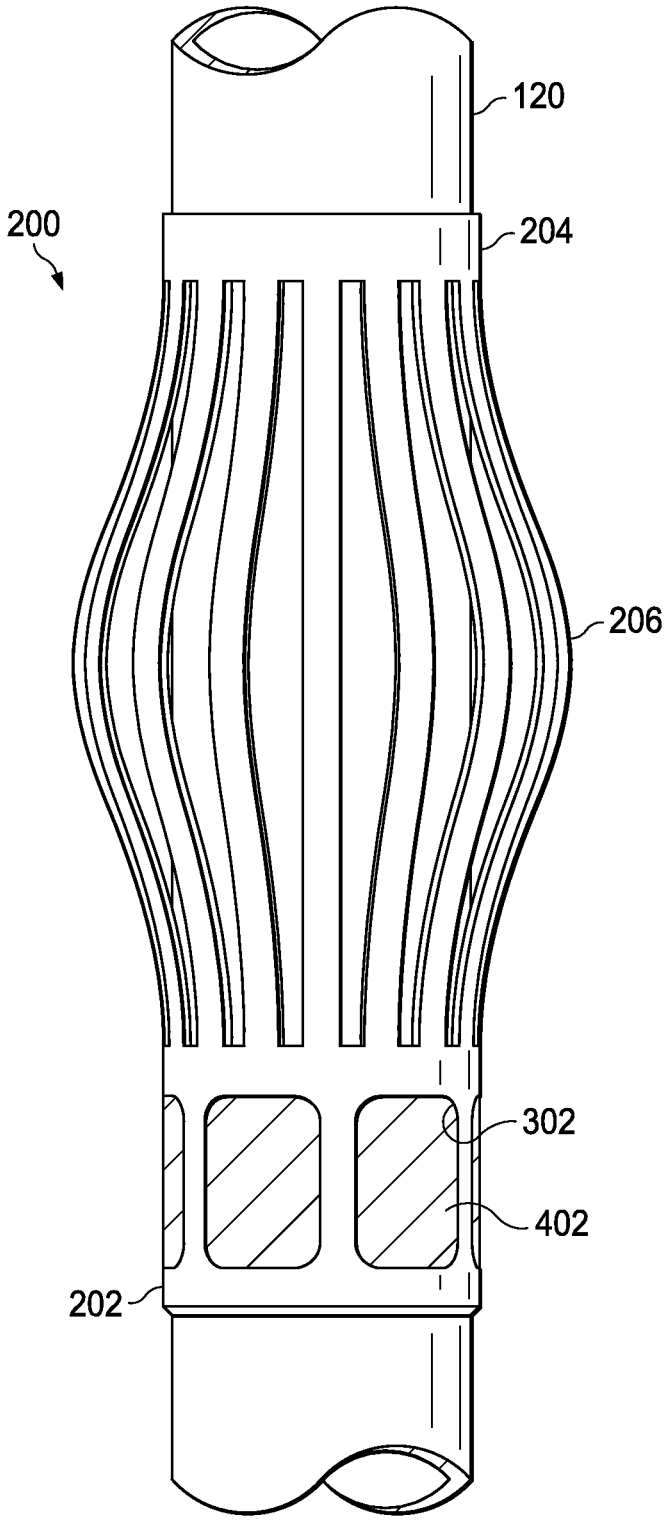
FIGS. 5A-5B are plan views of a centralizer disposed on a wellbore tubular according to yet another embodiment.

FIG. 5A illustrates the centralizer 200 disposed on a wellbore tubular 120 and having a retaining portion 402 disposed within a plurality of windows 302. While the retaining portion 402 is illustrated as being disposed within the windows 302 similar to the embodiment shown in FIG. 4A, any amount and design of the retaining portion 402 can be used to couple the centralizer 200 to the wellbore tubular 120. As shown in FIG. 5A, the centralizer 200 can be pulled into the wellbore (e.g., by being moved downward in FIG. 5A) by the interaction of the retaining portion 402 and the window 302. For example, the centralizer 200 may be pulled into the wellbore as the wellbore tubular 120 is conveyed into the wellbore due to the interaction of the retaining portion 402, which is fixedly coupled to the wellbore tubular 120, with the window 302 in the first body portion 202. By pulling the centralizer 200 into the wellbore, rather than pushing the centralizer 200 into the wellbore, the starting force required to insert the centralizer 200 into a restriction (e.g., a close tolerance restriction) may be reduced. Pulling may reduce the starting force by allowing the bow springs 206 to be radially compressed without also being longitudinally compressed, as could occur if the centralizer 200 where pushed into a restriction. Pulling the centralizer 200 during conveyance within the wellbore may also be advantageous in preventing potential damage and/or collapse of the centralizer 200 within the wellbore upon contacting an obstruction or close tolerance restriction.

Figure 5B:
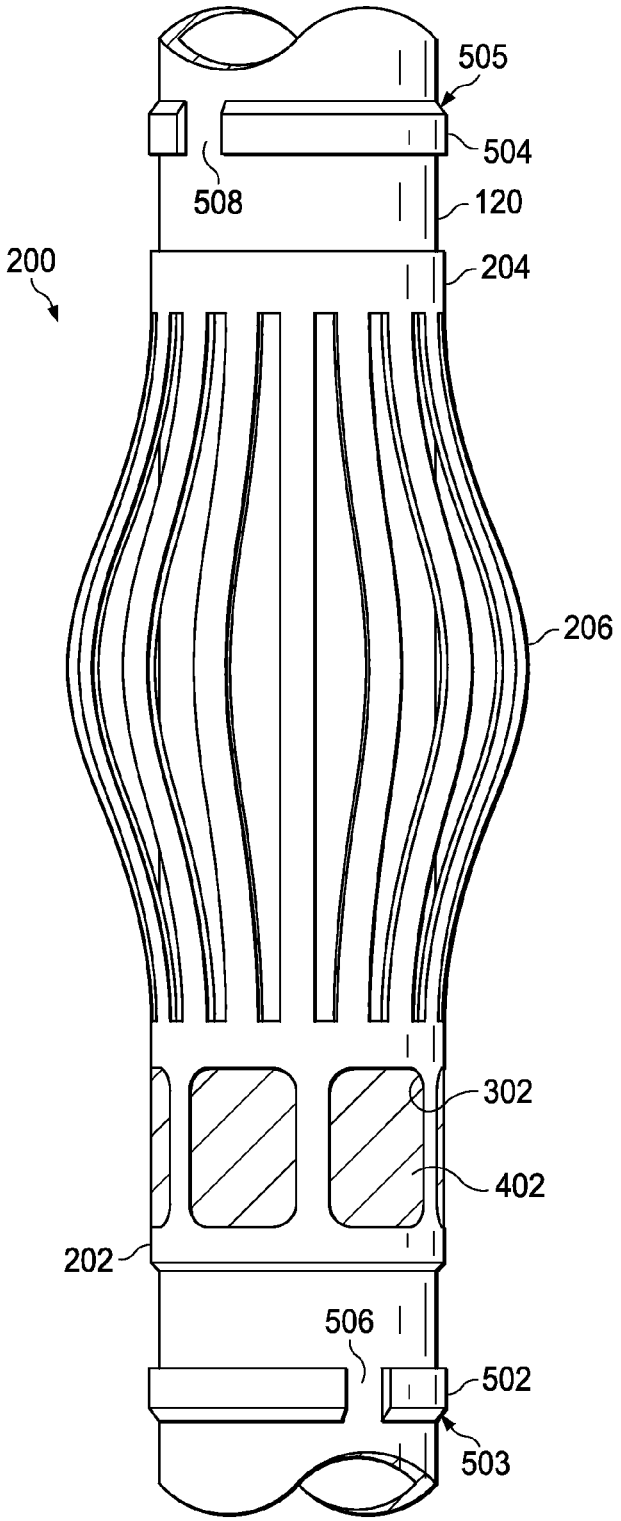

One or more optional guide collars 502, 504 may be included on the wellbore tubular 120 to initially center the centralizer 200 within the wellbore. As shown in FIG. 5B, the guide collars 502, 504 may be configured to align the wellbore tubular 120 and the centralizer 200 within the wellbore, for example upon entering a restriction, so that a restriction and/or the wellbore wall contacts the bow springs 206 at a suitable location for compressing the bow springs 206 rather than a body portion 202, 204, which may damage the centralizer 200. The guide collars 502, 504 may also function to serve as back-up stop collars in the event that bond between the retaining portion 402 and the wellbore tubular 120 fails. The one or more optional guide collars 502, 504 may have tapered leading and/or trailing edges 503, 505 to aid in guiding the centralizer 200 through the wellbore. In an embodiment, one or more channels 506, 508 may be disposed in the guide collars 502, 504 to allow fluid to flow past the guide collars 502, 504 during conveyance of the wellbore tubular 120 within the wellbore.

The optional guide collars 502, 504 may be disposed about a wellbore tubular 120 and maintained in place using any technique known in the art. The guide collars 502, 504 may be made from steel or similar high strength material. In an embodiment, the guide collars 502, 504 may be constructed from a composite material. The guide collars 502, 504 may be generally cylindrically shaped and may have an internal diameter selected to fit about the exterior of the wellbore tubular 120 to which they are to be affixed. The guide collars 502, 504 may be affixed to the exterior of the wellbore tubular 120 using set screws or any other device known in the art for such purpose. In an embodiment, the guide collars 502, 504 may be constructed of a composite material and may take the form of any of the stop collars shown in U.S. Patent Application Publication Nos. US 2005/0224123 A1, entitled "Integral Centraliser" and published on Oct. 13, 2005, and US 2007/0131414 A1, entitled "Method for Making Centralizers for Centralising a Tight Fitting Casing in a Borehole" and published on Jun. 14, 2007, both of which are incorporated herein by reference in their entirety.

Additional methods and materials may be used to form the guide collars 502, 504. In an embodiment, a projection may be formed on the wellbore tubular 120 using a composite material that is capable of forming a protrusion on the wellbore tubular 120. Suitable projections and methods of making the same are disclosed in U.S. Patent Application Publication No. 2005/0224123 A1 to Baynham et al. and published on Oct. 13, 2005, the entire disclose of which is incorporated herein by reference. The projections may comprise a composite material, which may comprise a ceramic based resin including, but not limited to, the types disclosed in U.S. Patent Application Publication Nos. US 2005/0224123 A1, entitled "Integral Centraliser" and published on Oct. 13, 2005, and US 2007/0131414 A1, entitled "Method for Making Centralizers for Centralising a Tight Fitting Casing in a Borehole" and published on Jun. 14, 2007, both of which were incorporated by reference above. In an embodiment, the guide collar may be formed using the same material and process used to form the retaining portion in the windows, as described in more detail herein.

Figure 6:
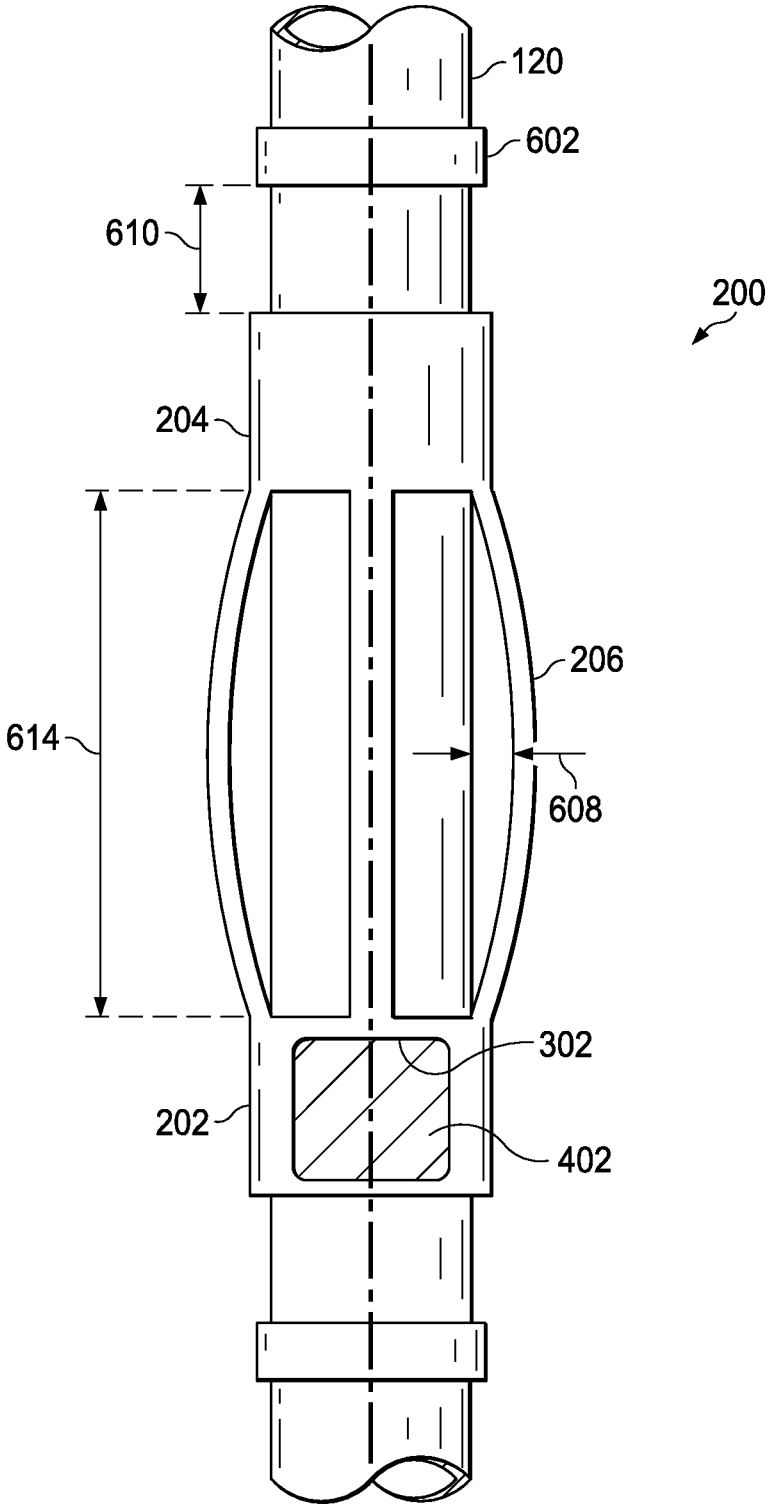
FIG. 6 is a plan view of a centralizer according to still another embodiment.

As shown in FIG. 6, the radial, inward compression of the bow springs 206 creates a longitudinal lengthening of the distance 614 between the first body portion 202 and the second body portion 204, thus increasing the overall length of the centralizer 200. The increase in length of the centralizer 200 is approximately the same as or greater than the radial distance 608 traveled by bow spring 206 during the compression. Since the retaining portion 402 fixedly couples the centralizer 200 to the wellbore tubular 120 at the first body portion 202, the longitudinal travel distance may be the greatest at the second body portion 204. In order to accommodate this longitudinal travel, the distance 610 between the end of the second body portion 204 and the guide collar 602 may be equal to or greater than the greatest radial travel distance 608 of the plurality of bow springs 206. In an embodiment, the distance 610 may be about 5% to about 10% greater than the distance 608 to allow for production tolerances during coupling of the centralizer 200 and the optional guide collar 602 to the wellbore tubular 120.

Figure 7A:
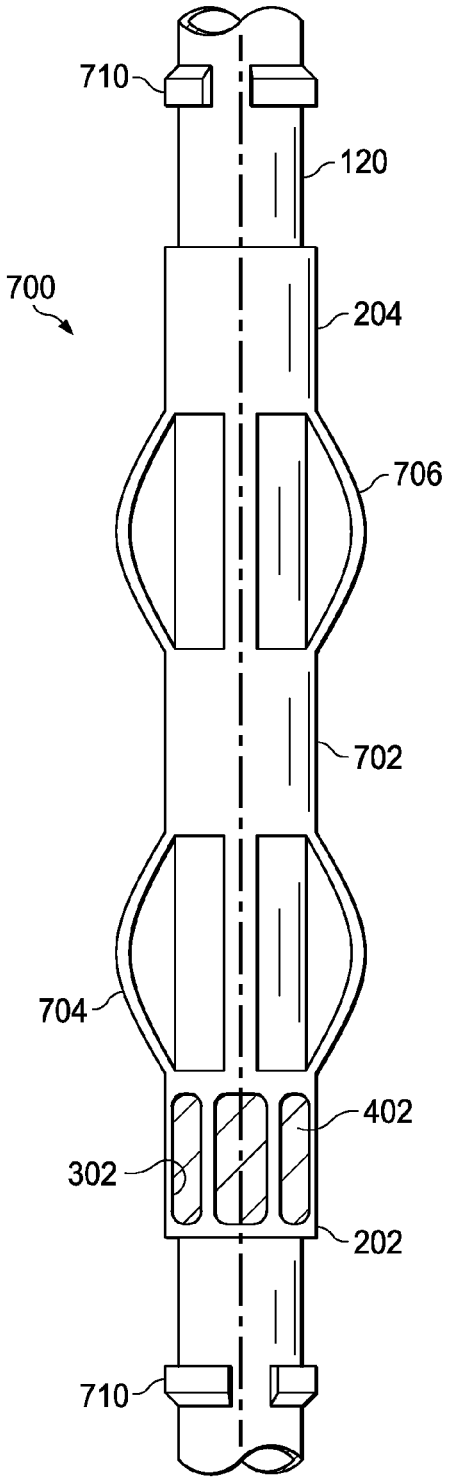
FIGS. 7A and 7B are plan views of a centralizer according to yet another embodiment.

In an embodiment shown in FIG. 7A, a multi-section centralizer 700 design is shown with a third body portion 702 disposed between the first body portion 202 and the second body portion 204. A first section 704 of a plurality of bow springs may be used to couple the first body portion 202 and the third body portion 702, and a second section 706 of the plurality of bow springs may be used to couple the third body portion 702 and the second body portion 204. The third body portion 702 may be similar in design to the first body portion 202, and/or the second body portion 204. The body portions 202, 204, 702 and the bow spring sections 704, 706 may comprise any of the designs discussed herein for the body portions and the bow springs. In an embodiment, the retaining portion 402 is disposed in one or more windows 302 in the first body portion 202. This configuration can allow the multi-section centralizer 700 to be pulled into the wellbore. As shown in FIG. 7A, the number of bow springs in the first section 704 and the second section 706 of bow springs may be the same, and the bow springs in each section may be aligned along the longitudinal axis of the wellbore tubular 120. In an embodiment, the number of bow springs in the first section 704 and the second section 706 of bow springs may be different. As also shown in FIG. 7A, one or more guide collars 710 can optionally be disposed on the wellbore tubular 120.

Figure 7B:
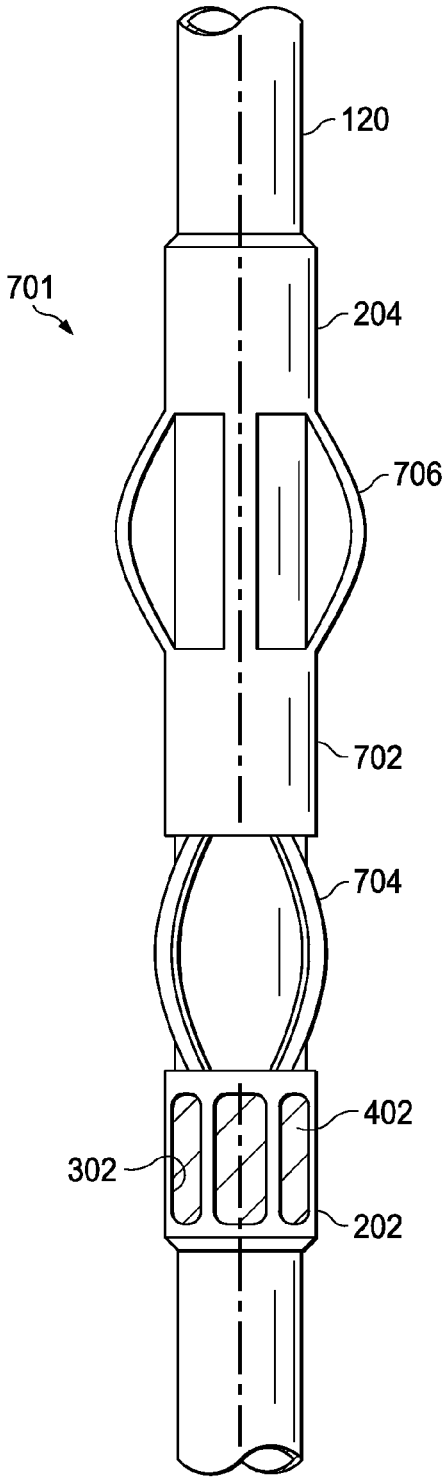

In another embodiment of a multi-section centralizer 701 as shown in FIG. 7B, the bow springs in each section may be radially offset about the central longitudinal axis so that the bow springs do not align along an outer surface of the wellbore tubular 120 in a direction parallel to the longitudinal axis of the wellbore tubular 120. In other words, the bow springs may be in a first radial alignment (e.g., at radial positions originating from a central longitudinal axis in a plane normal to the longitudinal axis) in a first section 704, and in a second radial alignment in a second section 706. As a non-limiting example, a first section 704 may have three bow springs with the bow springs aligned at radial positions corresponding to about 0 degrees, about 120 degrees, and about 240 degrees. In a second section 706 also comprising three bow springs, the bow springs may be aligned at radial positions corresponding to about 60 degrees, about 180 degrees, and about 300 degrees. In an embodiment, the bow springs in each section may align. While the bow springs have been described as being evenly distributed about the longitudinal axis, the bow springs may also be distributed unevenly about the longitudinal axis.

In another embodiment, the number of bow springs in the each section may be different, and/or the bow springs in each section may be offset so that the bow springs do not align. For example, the first section 704 may have 5 bow springs, and the second section 706 may have 3 bow springs. In this example, the bow springs in the first section and the second section may be arranged so that none of the bow springs 704 in the first section 704 align along the longitudinal axis of the wellbore tubular 120 with any of the bow springs 706. As a non-limiting example, a first section 704 may have five bow springs with the bow springs aligned at radial positions corresponding to about 0 degrees, about 72 degrees, about 144 degrees, about 216 degrees, and about 288 degrees. In a second section 706 comprising three bow springs, the bow springs may be aligned at radial positions corresponding to about 60 degrees, about 180 degrees, and about 300 degrees. In an embodiment, the use of multiple body portions to allow for additional bow springs between the first body portion 202 and the second body portion 204 may increase the restoring force without a corresponding increase in the starting force, allowing for the desired properties to be tailored based on the design of the centralizer.

It will be appreciated that while a third body portion 702 is illustrated, any number of additional body portions may be disposed between subsequent portions of the bow springs to connect the first body portion 202 to the second body portion 204. In an embodiment, a plurality of body portions may be coupled by a plurality of portions of bow springs. While a centralizer comprising a single section is described below for clarity, it is to be understood that the same concepts may be readily applied by one of ordinary skill in the art to a multi-section design.

Referring to FIGS. 4A-4C, the retaining portion 402, 404, 406 may comprise any material capable of retaining the centralizer 200 on the wellbore tubular 120 during conveyance of the wellbore tubular 120 within the wellbore. The retaining portion may comprise a metal, an alloy, a composite, a ceramic, a resin, an epoxy, or any combination thereof. The retaining portion may be disposed within the windows using any known techniques for applying the desired material. For example, a flame spray method, sputtering, welding, brazing, diffusion bonding, casting, molding, curing, or any combination thereof may be used to apply the retaining portion within the window.

In some embodiments, the retaining portion comprises a composite material. The composite material may comprise a ceramic based resin including, but not limited to, the types disclosed in U.S. Patent Application Publication Nos. US 2005/0224123 A1, entitled "Integral Centraliser" and published on Oct. 13, 2005, and US 2007/0131414 A1, entitled "Method for Making Centralizers for Centralising a Tight Fitting Casing in a Borehole" and published on Jun. 14, 2007. For example, in some embodiments, the resin material may include bonding agents such as an adhesive or other curable components. In some embodiments, components to be mixed with the resin material may include a hardener, an accelerator, or a curing initiator. Further, in some embodiments, a ceramic based resin composite material may comprise a catalyst to initiate curing of the ceramic based resin composite material. The catalyst may be thermally activated. Alternatively, the mixed materials of the composite material may be chemically activated by a curing initiator. More specifically, in some embodiments, the composite material may comprise a curable resin and ceramic particulate filler materials, optionally including chopped carbon fiber materials. In some embodiments, a compound of resins may be characterized by a high mechanical resistance, a high degree of surface adhesion and resistance to abrasion by friction.

In some embodiments, the composite material may be provided prior to injection and/or molding as separate two-part raw material components for admixing during injection and/or molding and whereby the whole can be reacted. The reaction may be catalytically controlled such that the various components in the separated two parts of the composite material will not react until they are brought together under suitable injection and/or molding conditions. Thus, one part of the two-part raw material may include an activator, initiator, and/or catalytic component required to promote, initiate, and/or facilitate the reaction of the whole mixed composition. In some embodiments, the appropriate balance of components may be achieved in a mold by use of pre-calibrated mixing and dosing equipment.

In an embodiment, the centralizer may be attached to the wellbore tubular by placing the centralizer on the wellbore tubular and disposing the retaining portion within the window in the first body portion or the second body portion. In other words, a sequential two-step process may be used to form an in situ retaining portion. In an embodiment, a composite retaining portion may be formed directly on the wellbore tubular through the use of a mold. In this process, the surface of the wellbore tubular accessible through the window may be prepared using any known technique to clean and/or provide a suitable surface for bonding the composite material to the wellbore tubular. In an embodiment, the surface of the wellbore tubular may be metallic, for example steel. The attachment surface may be prepared by sanding, sand blasting, bead blasting, chemically treating the surface, heat treating the surface, or any other treatment process to produce a clean surface for bonding the composite to the wellbore tubular. In an embodiment, the preparation process may result in a corrugated, stippled, or otherwise roughened surface, on a microscopic or macroscopic scale, to provide an increased surface area and suitable surface features to improve bonding between the surface and the composite resin material.

The prepared surface may then be covered with an injection mold. The injection mold may be suitably configured to provide the shape of the retaining portion with an appropriate height. The injection mold may be provided with an adhesive on a surface of the mold that contacts the wellbore tubular. It will be appreciated that the adhesive described in this disclosure may comprise any suitable material or device, including, but not limited to, tapes, glues, and/or hardenable materials such as room temperature vulcanizing silicone. The injection mold may be sealed against the prepared surface within the window. Following such generally sealing against the prepared surface, the composite material described herein may be introduced into a space between the injection mold and the prepare surface using a port disposed in the injection mold. The composite material may flow throughout the mold and form the retaining portion on the surface of the wellbore tubular. In an embodiment, the composite material may substantially fill the window into which it is disposed.

The composite material may be allowed to harden and/or set. For example, heat may be applied to thermally activate a thermally setting resin, or allowing a sufficient amount of time for the curing of the composite material. After the composite material has sufficiently hardened and/or set, the injection mold may be unsealed from the wellbore tubular. If needed, the retaining portion may be subsequently processed to provide the desired shape or configuration. The wellbore tubular comprising the centralizer may then be placed within a wellbore.

Figure 8A:
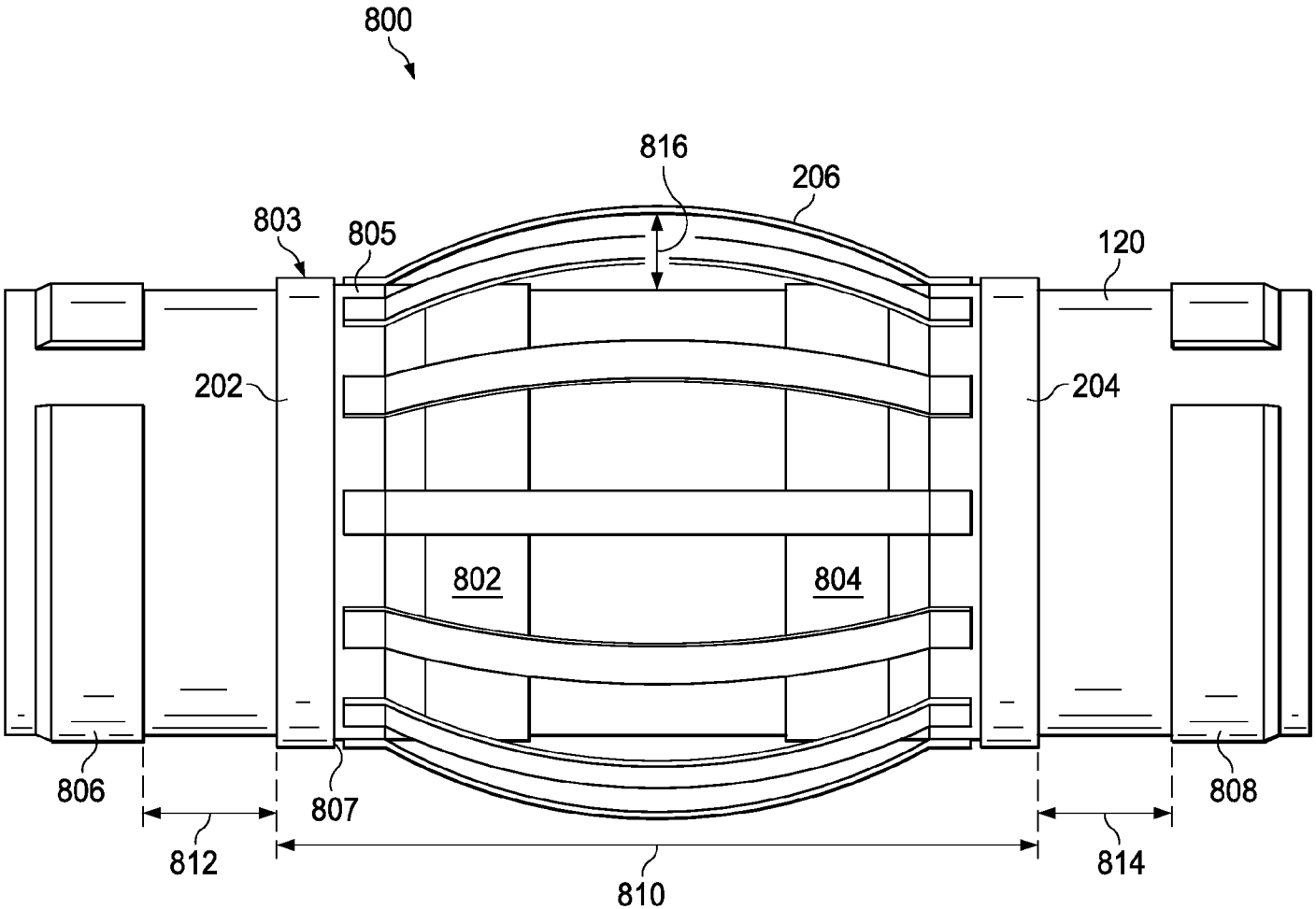
FIG. 8A is a plan view of a centralizer according to another embodiment.
Figure 8B:
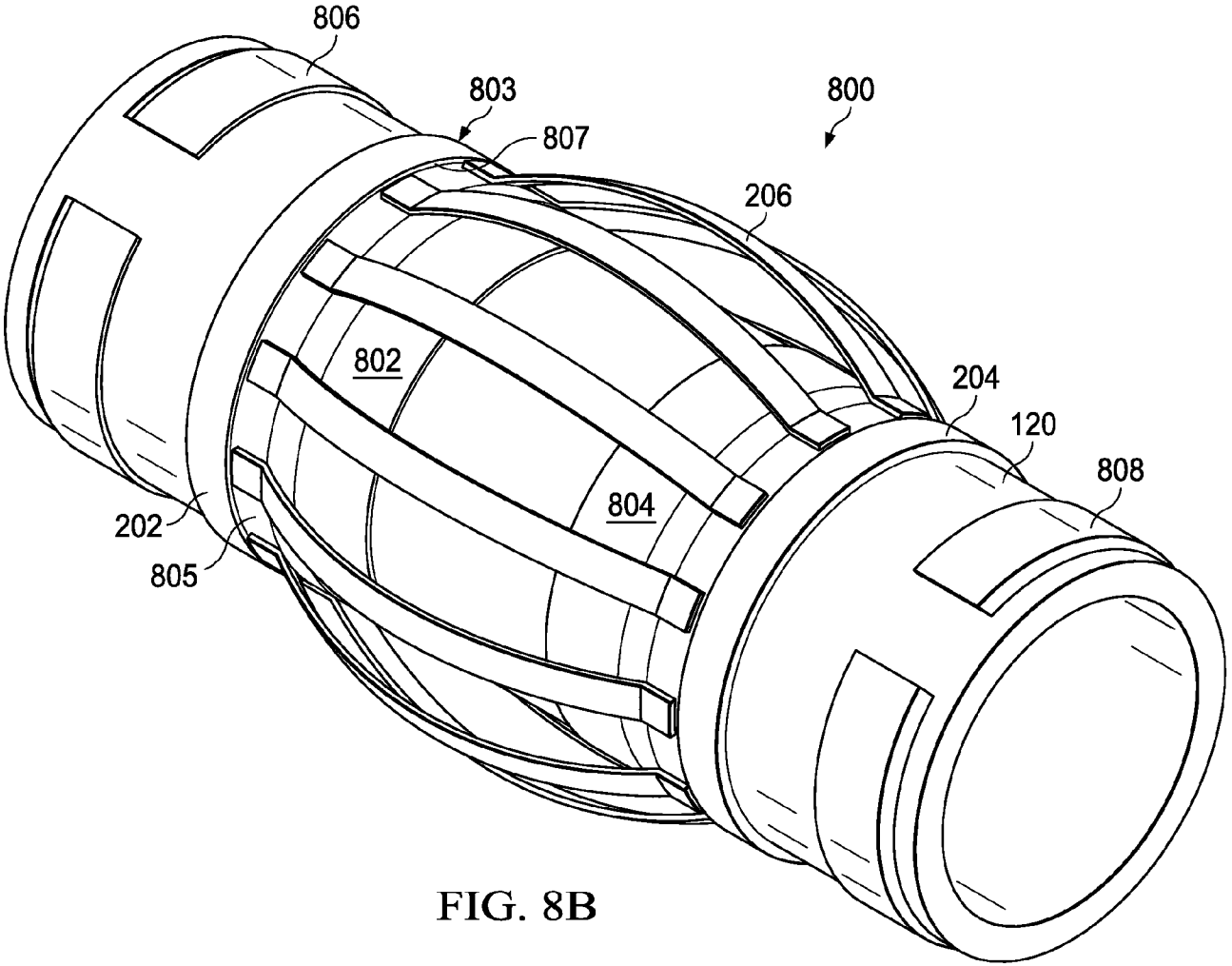
FIG. 8B is a perspective view of a centralizer according to another embodiment.

Additional designs may also be used to provide a pull-through centralizer. In an embodiment, a plurality of limit collars may be disposed between the first body portion and the second body portion and coupled to the wellbore tubular, where at least one of the plurality of limit collars is configured to engage the leading body portion in the direction of travel within the wellbore. The plurality of limit collars are coupled to the wellbore tubular and are configured to engage the body portions of the centralizer, thereby retaining the centralizer on the wellbore tubular. FIGS. 8A and 8B illustrate a centralizer 800 coupled to a wellbore tubular 120 having a plurality of limit collars 802, 804 disposed one the wellbore tubular 120 between the first body portion 202 and the second body portion 204. The plurality of bow springs 206 may extend between the first body portion 202 and the second body portion 204 about the wellbore tubular 120 and the plurality of limit collars 802, 804. One or more optional guide collars 806, 808 may be disposed on the wellbore tubular 120 with the centralizer 800 disposed therebetween.

Figure 9:
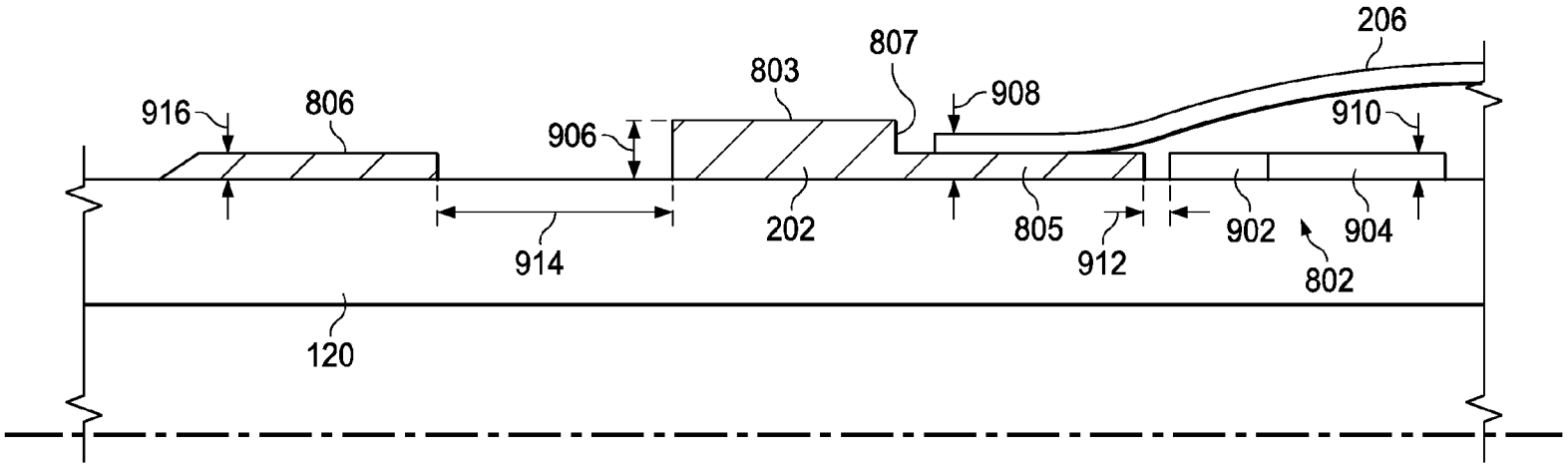
FIG. 9 is a partial cross-sectional view of embodiments of a centralizer.

FIG. 9 illustrates a partial cross-sectional view of the centralizer 800 disposed on the wellbore tubular 120. The bow spring 206 is coupled to the first body portion 202. In an embodiment, the first body portion 202 may comprise a stepped design with a first section 803 having a height 906 greater than a second section 805, forming a shoulder 807 therebetween. The bow spring 206 may be coupled to the second section 805, and the combined height 908 of the bow spring 206 and the second section 805 of the first body portion 202 may be the same as or less than the height 906 of the first section 803. The limit collar 802 may have a height 910 that is less than or equal to the height 906 of the first section 803 of the first body portion 202 and/or the height 908 of the bow spring 206 and the second section 805. In an embodiment, the height 910 of the limit collar 802 may be less than or equal to the height of the second section 805. In an embodiment, the height 908 of the bow spring 206 and the second section 805 of the first body portion 202 may be greater than the height 906 of the first section 803. The height 916 of any guide collar 806 may be the same as the height 906 of the first section 803, or the height 916 of the guide collar 806 may be less than or greater than the height 906 of the first section 803.

In an embodiment, the limit collar 802 may comprise a plurality of sections 802, 904. A first section 902 may be configured to engage the first body portion 202 and a second section 904 may be configured to retain the limit collar on the wellbore tubular. In an embodiment, the second section 904 may comprise a material that engages, couples, and/or bonds to the wellbore tubular 120. In an embodiment, the second section 904 may provide the majority of the retaining force exhibited by the limit collar 802. The first section 902 may comprise an interface component that may engage the second section 904 and prevent point loading of an applied force directly to the second section. By distributing a load applied to the limit collar 802 through the first section 902, point loading and the resulting potential failure of the second section 904 may be reduced or avoided, thereby improving the load capacity of the limit collar 802. Embodiments of a limit collar comprising a multi-section design are described in U.S. patent application Ser. No. 13/093,242 to Levie et al., filed on Apr. 25, 2011, entitled "Improved Limit Collar," published as U.S. patent application Publication No. US 20120267121, which is incorporated herein by reference in its entirety.

Referring to FIGS. 8A, 8B, and 9, the plurality of limit collars 802, 804 may be generally disposed on the wellbore tubular 120 with any configuration to allow the centralizer 800 to be disposed about the plurality of limit collars 802, 804. In an embodiment, the plurality of limit collars 802, 804 may be configured to engage the body portion 202, 204 in the leading direction of travel within the wellbore, thereby pulling the centralizer in the direction of travel. For example, the plurality of limit collars 802, 804 may be configured to allow limit collar 802 to engage first body portion 202 when the wellbore tubular 120 of FIG. 8A of moved to the left, and the plurality of limit collars 802, 804 may be configured to allow limit collar 804 to engage second body portion 204 when the wellbore tubular 120 of FIG. 8A of moved to the right.

In an embodiment, the plurality of limit collars 802, 804 may be configured to limit the amount of longitudinal translation of the centralizer 800 on the wellbore tubular 120. The limited travel along the wellbore tubular may be advantageous in limiting the degree to which the centralizer 800 can cycle on the wellbore tubular 120 when the wellbore tubular 120 is cycled within the wellbore, for example, when working the wellbore tubular 120 past a close tolerance restriction. In an embodiment, the longitudinal travel distance of the centralizer 800 on the wellbore tubular may be limit to less than about 30% of the overall length 810 of the centralizer 800, less than about 20% of the overall length 810 of the centralizer 800, or less than about 15% of the overall length of the wellbore tubular.

In an embodiment, the plurality of limit collars 802, 804 may be configured to have a distance 912 between the limit collars 802, 804, and the body portions 202, 204, respectively. The distance 912 may be between about 0.1% and about 30%, between about 0.5% and about 20%, or about 1% and about 10% of the overall length 810 of the centralizer 800. In an embodiment, the plurality of limit collars 802, 804 may be configured to engage the body portions 202, 204, respectively, when the centralizer is in an uncompressed state. The radial, inward compression of the bow springs 206 creates a longitudinal lengthening of the overall length 810 of the centralizer 800. The increase in length of the centralizer 800 is approximately the same as or greater than the radial distance 816 traveled by bow spring 206 during the compression. The distance 912, which is present between both the limit collar 802 and the first body portion 202 and the limit collar 804 and the second body portion 204, may be created by the longitudinal expansion of the centralizer 800 due to the compression of the bow springs 206. In still another embodiment, the plurality of limit collars 802, 804 may be configured to engage the body portions 202, 204, respectively, when the centralizer 800 is in a partially compressed state. The limit collars 802, 804 may thereby maintain some tension between the body portions 202, 204 when the bow springs 206 are not otherwise compressed (e.g., by being disposed in a wellbore). Upon compressing the bow springs 206, the body portions 202, 204 may move apart thereby creating a spacing of distance 912. In this embodiment, the distance 912 created by the compression of the bow springs 206 may be less than about 30%, less than about 20%, or less than about 10% of the overall length 810 of the centralizer 800. In an embodiment, the distance 912 created by the compression of the bow springs 206 may be less than a similar distance 912 created by the compression of the bow springs when the limit collars 802, 804 do not maintain some tension between the body portions 202, 204.

One or more optional guide collars 806, 808 may be included on the wellbore tubular 120 adjacent the centralizer 800. The optional guide collars 806, 808 may be the same or similar to the optional guide collars described with respect to FIG. 5B. The optional guide collars 806, 808 may be disposed about a wellbore tubular 120 and maintained in place using any of the techniques described herein. The guide collars 806, 808 may be formed from any of the materials described herein. As described above, the radial, inward compression of the bow springs 206 creates a longitudinal lengthening of the overall length 810 of the centralizer 800 by approximately the same distance 816 traveled by bow spring 206 during the compression. In order to accommodate this longitudinal lengthening and allow the limit collar 802 to engage the first body portion 202 and pull the centralizer 800 into the wellbore, the distance 814 between the end of the second body portion 204 and the optional guide collar 808 may be equal to or greater than the greatest radial travel distance 816 of the plurality of bow springs 206. Similarly, the distance 812 between the end of the first body portion 202 and the optional guide collar 806 may be equal to or greater than the greatest radial travel distance 816 of the plurality of bow springs 206. In an embodiment, the distances 812, 814 may be about 5% to about 10% greater than the distance 816 to allow for production tolerances during coupling of the centralizer 800 and the optional guide collars 806, 808 to the wellbore tubular 120.

Referring to FIGS. 8A and 9, the height 906 of the first body portion 202 and/or the second body portion 204, the height 910 of the limit collars 806, 808, and/or the height 916 of any optional guide collars may vary depending on the width of the annulus available between the wellbore tubular 120 and the side of the wellbore or the inner surface of the casing, depending on whether or not the wellbore has been cased. Due to the tolerances available within a wellbore, a well operator may specify a minimum tolerance for the space between the outermost surface of a wellbore tubular 120, including the centralizer 800, and the inner surface of the wellbore or the casing disposed within the wellbore. Using the tolerance, the height of the first body portion 202, the second body portion 204, the limit collars 802, 804, and/or any optional guide collars 806, 808 may be less than the annular diameter difference minus the tolerance set by the well operator. In an embodiment, the tolerance may be about 0.1 inches to about 0.2 inches. In an embodiment, no tolerance may be allowed other than the pipe manufacturer's tolerances, which may be based on industry standards (e.g., American Petroleum Institute (API) standards applicable to the production of a wellbore tubular), of about 1% based on the outer diameter of the wellbore tubular 120 and the drift tolerance of the inner diameter of the close tolerance restriction present in the wellbore (e.g., a casing through which the wellbore tubular comprising the centralizer passes). The minimum height of the first body portion 202, the second body portion 204, the limit collars 802, 804, and/or any optional guide collars 806, 808 may be determined based on the structural and mechanical properties of the first body portion 202, the second body portion 204, the limit collars 802, 804, and/or any optional guide collars 806, 808. The height of each of the first body portion 202, the second body portion 204, the limit collars 802, 804, and/or any optional guide collars 806, 808 may the same or different. The height of the corresponding limit collar and body portion pair may generally be similar to allow for a sufficient interference between the limit collar and the edge of the body portion to apply the required force to pull the centralizer 200 into the wellbore.

Figure 10A:
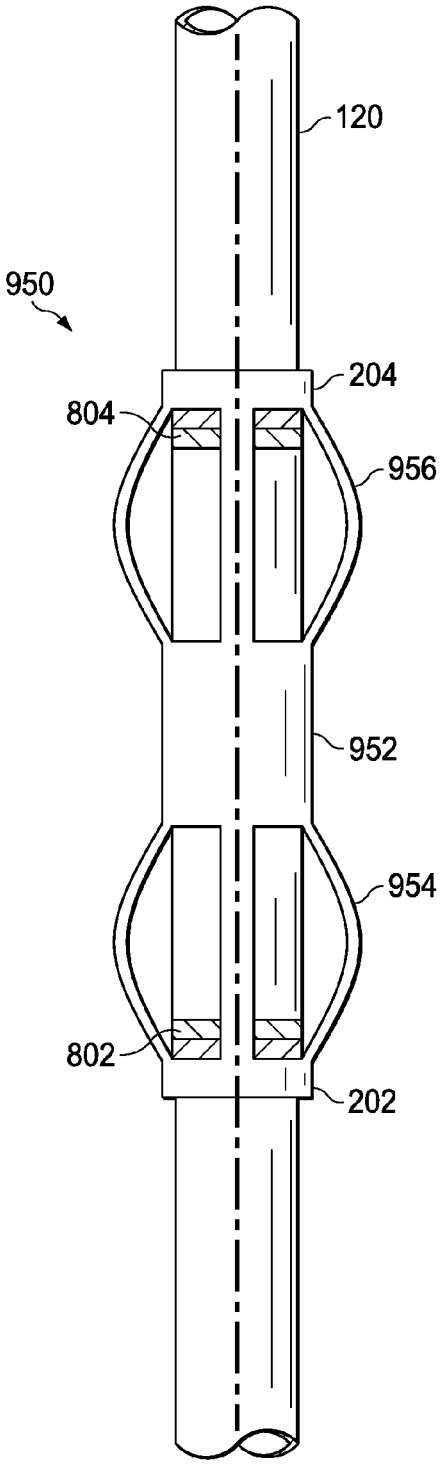
FIGS. 10A and 10B are plan views of centralizers according to another embodiment.

In an embodiment shown in FIG. 10A, a multi-section centralizer 950 design is shown with a third body portion 952 disposed between the first body portion 202 and the second body portion 204. A first section 954 of a plurality of bow springs may be used to couple the first body portion 202 and the third body portion 952, and a second section 956 of the plurality of bow springs may be used to couple the third body portion 952 and the second body portion 204. The third body portion 952 may be similar in design to the first body portion 202, and/or the second body portion 204. The body portions 202, 204, 952 and the bow spring sections 954, 956 may comprise any of the designs discussed herein for the body portions and the bow springs. In an embodiment, the limit collar 802 may be disposed adjacent the first body portion 202 and the limit collar 804 may be disposed adjacent the second body portion 204. In this configuration, the centralizer 950 may be pulled into the wellbore due to the interaction of the limit collar 802, 804 with the respective body portion 202, 204 in the direction of travel of the wellbore tubular 120. As shown in FIG. 10A, the number of bow springs in the first section 954 and the second section 956 of bow springs may be the same, and the bow springs in each section may be aligned along the longitudinal axis of the wellbore tubular. In an embodiment, the number of bow springs in the first section 704 and the second section 706 of bow springs may be different. Any of the considerations with respect to the number of bow springs in each section 954, 956 and their alignment may be the same or similar to those considerations described with respect to FIGS. 7A and 7B. It will be appreciated that while a third body portion 952 is illustrated, any number of additional body portions may be disposed between subsequent portions of the bow springs to connect the first body portion 202 to the second body portion 204. In an embodiment, a plurality of body portions may be coupled by a plurality of portions of bow springs.

Figure 10B:
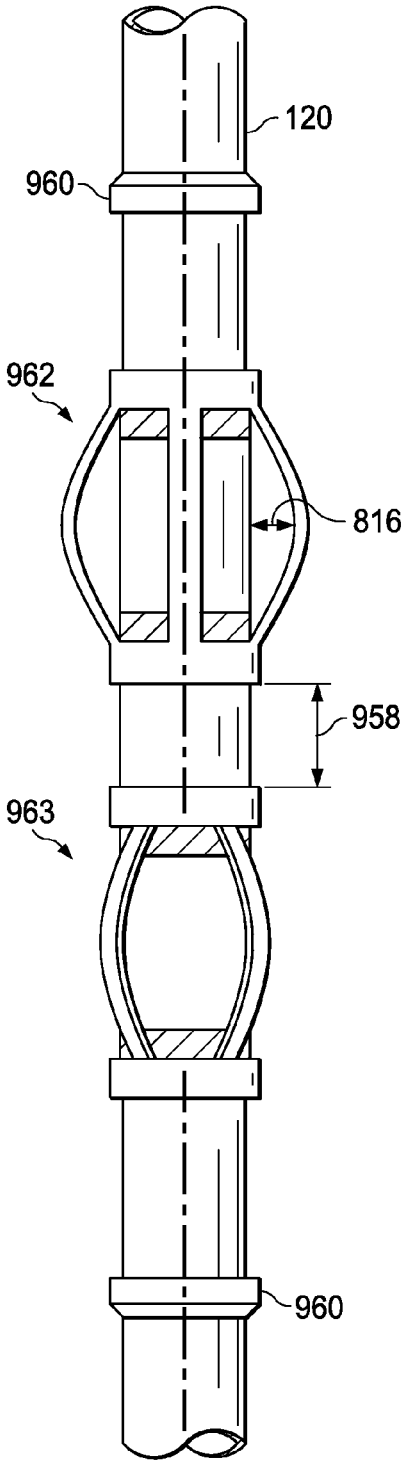

In an embodiment shown in FIG. 10B, a plurality of centralizers 962, 963, each comprising a plurality of limit collars disposed between the body portions, may be disposed on a wellbore tubular between optional guide collars 960. The design of the centralizers having a plurality of limit collars disposed between the body portions may allow the centralizers 962, 963 to be placed adjacent each other with a limited distance therebetween. As noted above, the radial, inward compression of the bow springs on each centralizer 962, 963 creates a longitudinal lengthening of the centralizers 962, 963, which may be the same or greater than the radial distance 816 traveled by bow spring during the compression. Thus, the centralizers 962, 963 can be disposed adjacent one another with a spacing distance 958 being equal to or greater than the radial distance 816, thereby allowing each individual centralizer 962, 963 to be pulled into the wellbore.

Returning to FIG. 8A, the limit collars 802, 804 may comprise any material capable of retaining the centralizer 800 on the wellbore tubular 120 during conveyance of the wellbore tubular 120 within the wellbore. In an embodiment, the limit collars 802, 804 may comprise one or more traditional stop collars comprising metal rings with couplers (e.g., set screws) disposed therein to retain the limit collar in position relative to the wellbore tubular 120. In an embodiment, the limit collars 802, 804 may comprise a metal, an alloy, a composite, a ceramic, a resin, an epoxy, or any combination thereof. The limit collars 802, 804 may be disposed on and coupled to the wellbore tubular 120 using any known techniques for applying the desired material. For example, a flame spray method, sputtering, welding, brazing, diffusion bonding, casting, molding, curing, or any combination thereof may be used to apply the limit collars 802, 804 to the wellbore tubular 120 between the first body portion 202 and the second body portion 204.

In some embodiments, the limit collars 802, 804 comprise a composite material. The composite material may comprise a ceramic based resin as described in more detail above including, but not limited to, the types disclosed in U.S. Patent Application Publication Nos. US 2005/0224123 A1, entitled "Integral Centraliser" and published on Oct. 13, 2005, and US 2007/0131414 A1, entitled "Method for Making Centralizers for Centralising a Tight Fitting Casing in a Borehole" and published on Jun. 14, 2007. More specifically, in some embodiments, the composite material may comprise a curable resin and ceramic particulate filler materials, optionally including chopped carbon fiber materials. In some embodiments, a compound of resins may be characterized by a high mechanical resistance, a high degree of surface adhesion and resistance to abrasion by friction.

In an embodiment, the limit collars 802, 804 may be coupled to the wellbore tubular by placing the centralizer 800 on the wellbore tubular 120 and disposing the plurality of limit collars 802, 804 on the wellbore tubular 120 between the first body portion 202 and the second body portion 204. In an embodiment, composite limit collars 802, 804 may be formed directly on the wellbore tubular 120 through the use of a mold. In this process, all or suitable portions of the surface of the wellbore tubular 120 between the first body portion 202 and the second body portion 204 may be prepared using any known technique to clean and/or provide a suitable surface for bonding the composite material to the wellbore tubular 120. In an embodiment, the surface of the wellbore tubular 120 may be metallic, for example steel. The attachment surface may be prepared by sanding, sand blasting, bead blasting, chemically treating the surface, heat treating the surface, or any other treatment process to produce a clean surface for bonding the composite to the wellbore tubular. In an embodiment, the preparation process may result in a corrugated, stippled, or otherwise roughened surface, on a microscopic or macroscopic scale, to provide an increased surface area and suitable surface features to improve bonding between the surface and the composite resin material.

The prepared surface may then be covered with an injection mold. The injection mold may be suitably configured to provide the shape of the plurality of limit collars 802, 804 and retain any optional interface component(s) for forming a multi-section limit collar. The mold may be configured to be disposed between the bow springs and/or be slipped onto the wellbore tubular 120 during the placement of the centralizer 800 about the wellbore tubular 120. The injection mold may be provided with an adhesive on a surface of the mold that contacts the wellbore tubular 120. It will be appreciated that the adhesive described in this disclosure may comprise any suitable material or device, including, but not limited to, tapes, glues, and/or hardenable materials such as room temperature vulcanizing silicone. The injection mold may be sealed against the prepared surface on the wellbore tubular 120. Following such generally sealing against the prepared surface, the composite material described herein may be introduced into a space between the injection mold and the prepare surface using a port disposed in the injection mold.

The composite material may flow throughout the mold and form the limit collars or a portion of the limit collars on the surface of the wellbore tubular 120.

The composite material may be allowed to harden and/or set. For example, heat may be applied to thermally activate a thermally setting resin, or allowing a sufficient amount of time for the curing of the composite material. After the composite material has sufficiently hardened and/or set, the injection mold may be unsealed from the wellbore tubular 120 and removed. The wellbore tubular 120 comprising the limit collars retaining the centralizer 800 may then be placed within a wellbore.

In use, the centralizer may be used to centralize a wellbore tubular within a wellbore. As noted herein, a wellbore tubular may be provided with a centralizer coupled thereto. The centralizer may comprise a first body portion, a second body portion, a plurality of bow springs connecting the first body portion to the second body portion. As the wellbore tubular is conveyed within the wellbore, the restoring force provided by the plurality of bow springs may serve to space the wellbore tubular from the wellbore walls. In general, the centralizing effect may occur when a bow spring is radially compressed inward from a starting position to a compressed position. As a result of the restoring force of the plurality of bow springs, the bow spring can be restored from the compressed position to the starting position. For example, when the wellbore tubular enters a portion of the wellbore having an increased diameter, the bow springs may move radially outward and may engage the wellbore wall and/or the wall of an outer wellbore tubular.

In an embodiment, a plurality of centralizers may be used with one or more wellbore tubular sections. A wellbore tubular string refers to a plurality of wellbore tubular sections connected together for conveyance within the wellbore. For example, the wellbore tubular string may comprise a casing string conveyed within the wellbore for cementing. The wellbore casing string may pass through the wellbore prior to the first casing string being cemented, or the casing string may pass through one or more casing strings that have been cemented in place within the wellbore. In an embodiment, the wellbore tubular string may comprise premium connections, flush connections, and/or nearly flush connections. One or more close tolerance restrictions may be encountered as the wellbore tubular string passes through the wellbore or the casing strings cemented in place within the wellbore (e.g., for example through lengths of concentric casing strings of progressively narrower diameter and/or into an under reamed section). A plurality of centralizers as described herein may be used on the wellbore tubular string to centralize the wellbore tubular string as it is conveyed within the wellbore. The number of centralizers and their respective spacing along a wellbore tubular string may be determined based on a number of considerations including the properties of each centralizer (e.g., the restoring force, the starting force, the drag force, etc.), the properties of the wellbore tubular (e.g., the sizing, the weight, etc.), and the properties of the wellbore through which the wellbore tubular is passing (e.g., the annular diameter difference, the tortuosity, the orientation of the wellbore, etc.). In an embodiment, a wellbore design program may be used to determine the number and type of the centralizers based on the various inputs as described herein. The number of centralizers and the spacing of the centralizers along the wellbore tubular may vary along the length of the wellbore tubular based on the expected conditions within the wellbore.

In an embodiment, a plurality of centralizers comprising a first body portion, a second body portion, and a plurality of bow springs connecting the first body portion to the second body portion, may be coupled to a wellbore tubular string using any of the configurations disclosed herein. For example, a retaining portion may be disposed within a window on a body portion of the centralizer to substantially fixedly couple the body portion to the wellbore tubular. The body portion comprising the one or more windows may be the leading body portion to allow the centralizer to be pulled into the wellbore. As another example, a plurality of limit collars may be disposed on the wellbore tubular between the first body portion and the second body portion to retain the centralizer on the wellbore tubular. The wellbore tubular string may then be placed in the wellbore disposed in a subterranean formation. In an embodiment, the wellbore may comprise at least one close tolerance restriction within the wellbore.

In an embodiment, a method of centralizing a wellbore tubular comprises engaging a centralizer coupled to a wellbore tubular with a restriction in a wellbore, wherein the centralizer comprises: a first body portion, a second body portion, a plurality of bow springs connecting the first body portion to the second body portion, and at least one window disposed in the first body portion, and wherein the centralizer is coupled to the wellbore tubular by a retaining portion disposed in the at least one window; and radially compressing the bow springs, wherein the first body portion is fixedly engaged with the wellbore tubular during the radially compressing of the bow springs. In another embodiment, a method of centralizing a wellbore tubular comprises conveying a centralizer coupled to a wellbore tubular in a first direction within a wellbore, wherein the centralizer comprises: a first body portion, a second body portion, and a plurality of bow springs connecting the first body portion to the second body portion, wherein the centralizer is coupled to the wellbore tubular by a plurality of limit collars coupled to the wellbore tubular between the first body portion and the second body portion, and wherein the centralizer is pulled in the first direction by an engagement between a first of the plurality of limit collars and the first body portion; and conveying the centralizer in a second direction within the wellbore, wherein the centralizer is pulled in the second direction by an engagement between a second of the plurality of limit collars and the second body portion. In still another embodiment, a method of centralizing a wellbore tubular comprises conveying a centralizer coupled to a wellbore tubular in a first direction within a wellbore; and conveying the centralizer in a second direction within the wellbore, wherein the centralizer is limited to a longitudinal translation of less than about 30% of an overall length of the centralizer relative to the wellbore tubular between being conveyed in the first direction and being conveyed in the second direction.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_1$, and an upper limit, $R_u$, is disclosed, any number falling within the range is specifically disclosed. In particular, the following numbers within the range are specifically disclosed: $R=R_1+k*(R_u-R_1)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. A centralizer system comprising:

a centralizer disposed about a wellbore tubular, wherein the centralizer comprises;

a first body portion, a second body portion, and a plurality of bow springs connecting the first body portion to the second body portion; and a plurality of limit collars coupled to the wellbore tubular between the first body portion and the second body portion, wherein at least one of the plurality of limit collars comprises a plurality of sections, wherein a first section of the plurality of sections comprises an interface component that is configured to engage at least one of the first body portion or the second body portion and prevent point loading of an applied force directly to the at least one of the first body portion or the second body portion, and wherein a second section of the plurality of sections is bonded to the wellbore tubular and comprises a retaining component configured to fixedly couple the interface component to the wellbore tubular, where at least one of the plurality of limit collars is configured to engage the first body portion or the second body portion and pull the centralizer in the direction of travel within the wellbore.

2. The centralizer system of claim 1, wherein a first of the plurality of limit collars is configured to engage the first body portion and a second of the plurality of limit collars is configured to engage the second body portion.

3. The centralizer of claim 2, wherein a total distance comprising a sum of a first distance between the first of the plurality of limit collars and the first body portion and a second distance between the second of the plurality of limit collars and the second body portion is between about 0.1% and about 30% of an overall length of the centralizer, wherein the overall length of the centralizer is a length between the outer ends of the centralizer when the centralizer is in an uncompressed state.

4. The centralizer system of claim 1, wherein the plurality of limit collars are configured to limit the longitudinal translation of the centralizer on the wellbore tubular to less than about 30% of an overall length of the centralizer.

5. The centralizer system of claim 1, wherein the plurality of limit collars engage the first body portion and the second body portion when the centralizer is in an uncompressed state.

6. The centralizer system of claim 1, wherein the plurality of limit collars engage the first body portion and the second body portion when the centralizer is in a partially compressed state.

7. The centralizer system of claim 1, wherein at least one of the plurality of limit collars comprises a metal, an alloy, a composite, a ceramic, a resin, an epoxy, or any combination thereof.

8. The centralizer system of claim 1, wherein the centralizer further comprises a third body portion disposed between a first portion of the plurality of bow springs and a second portion of the plurality of bow springs.

9. The centralizer system of claim 1, wherein at least one of the first body portion, the second body portion, or the plurality of bow springs are made from a material selected from the group consisting of: steel, a synthetic material, a composite material, or any combination thereof.

10. The centralizer system of claim 1, further comprising one or more guide collars disposed on the wellbore tubular.

11. The centralizer system of claim 10, wherein at least one edge of the one or more guide collars tapered.

12. A method of centralizing a wellbore tubular comprising:

conveying a centralizer coupled to a wellbore tubular in a first direction within a wellbore, wherein the centralizer comprises: a first body portion, a second body portion, and a plurality of bow springs connecting the first body portion to the second body portion, wherein the centralizer is coupled to the wellbore tubular by a plurality of limit collars coupled to the wellbore tubular between the first body portion and the second body portion, and wherein the centralizer is pulled in the first direction by an engagement between a first of the plurality of limit collars and the first body portion;

guiding the centralizer through the wellbore in the first direction using a guide collar disposed about the wellbore tubular, wherein the guide collar is disposed about the wellbore tubular adjacent to the first body portion, wherein a longitudinal space exists between the guide collar and the first body portion;

conveying the centralizer in a second direction within the wellbore, wherein the centralizer is pulled in the second direction by an engagement between a second of the plurality of limit collars and the second body portion.

13. The method of claim 12, wherein at least one of the plurality of limit collars comprises a material selected from the group consisting of: a composite, a ceramic, a resin, an epoxy, a polymer, a metal, an alloy, or any combination thereof.

14. The method of claim 12, wherein at least one of the plurality of limit collars comprises a composite material, and wherein the composite material comprises a fiber and a matrix material.

15. The method of claim 14, wherein the fiber comprise a glass fiber, a cellulosic fiber, a carbon fiber, a graphite fiber, a metal fiber, a ceramic fiber, a metallic-ceramic fiber, an aramid fiber, or any combination thereof.

16. The method of claim 12, wherein at least one of the plurality of limit collars comprises a plurality of sections, wherein a first section of the plurality of sections comprises an interface component that is configured to engage at least one of the first body portion or the second body portion, and wherein the first section is coupled to the wellbore tubular by a second section.

17. The method of claim 12, wherein the longitudinal space is equal to or greater than a radial travel distance of the plurality of bow springs between an uncompressed state and a fully compressed state.

18. The method of claim 12, wherein the guide collar comprises a longitudinal channel extending through the guide collar.

19. The method of claim 12, wherein the centralizer is limited to a longitudinal translation on the wellbore tubular of less than about 30% of an overall length of the centralizer between being conveyed in the first direction and being conveyed in the second direction, wherein the overall length of the centralizer is a length between the outer ends of the centralizer when the centralizer is in an uncompressed state.

20. A method of centralizing a wellbore tubular comprising:

conveying a centralizer coupled to a wellbore tubular in a first direction within a wellbore; and conveying the centralizer in a second direction within the wellbore, wherein the centralizer is limited to a longitudinal translation on the wellbore tubular of less than about 30% of an overall length of the centralizer between being conveyed in the first direction and being conveyed in the second direction, wherein the overall length of the centralizer is a length between the outer ends of the centralizer when the centralizer is in an uncompressed state.

* * * * *